US010837693B2

(12) United States Patent
Kim

(10) Patent No.: US 10,837,693 B2
(45) Date of Patent: Nov. 17, 2020

(54) REFRIGERATOR

(71) Applicant: LG Electronics Inc., Seoul (KR)

(72) Inventor: Jiwon Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 163 days.

(21) Appl. No.: 16/050,630

(22) Filed: Jul. 31, 2018

(65) Prior Publication Data

US 2019/0032989 A1 Jan. 31, 2019

(30) Foreign Application Priority Data

Jul. 31, 2017 (KR) ..... 10-2017-0097152

(51) Int. Cl.

| | |
|---|---|
| ***F25D 17/08*** | (2006.01) |
| ***F25D 17/06*** | (2006.01) |
| ***F25B 13/00*** | (2006.01) |
| ***F25D 23/00*** | (2006.01) |
| *F25B 39/02* | (2006.01) |
| *F25B 5/00* | (2006.01) |

(52) U.S. Cl.

CPC ..... *F25D 17/067* (2013.01); *F25B 13/00* (2013.01); *F25D 17/062* (2013.01); *F25D 17/08* (2013.01); *F25D 23/006* (2013.01); *F25B 5/00* (2013.01); *F25B 39/024* (2013.01); *F25D 2317/067* (2013.01); *F25D 2317/0651* (2013.01); *F25D 2317/0665* (2013.01); *F25D 2317/0681* (2013.01)

(58) Field of Classification Search

CPC .. F25D 17/08; F25D 2317/067; F25D 17/067; F25D 17/062; F25B 5/00

See application file for complete search history.

(56) References Cited

U.S. PATENT DOCUMENTS

| | | | | |
|---|---|---|---|---|
| 5,960,641 | A * | 10/1999 | Kim | F25D 17/065 62/404 |
| 2002/0059805 | A1* | 5/2002 | Lee | F25D 17/045 62/407 |
| 2007/0157646 | A1* | 7/2007 | Kim | F25D 17/042 62/187 |
| 2008/0202149 | A1* | 8/2008 | Lim | F25D 17/062 62/407 |

(Continued)

FOREIGN PATENT DOCUMENTS

KR 1020060132770 12/2006

*Primary Examiner* — Cassey D Bauer
*Assistant Examiner* — Lionel Nouketcha
(74) *Attorney, Agent, or Firm* — Fish & Richardson P.C.

(57) ABSTRACT

A refrigerator includes a cabinet, an evaporator, an evaporator cover module defining an evaporator cover module, a cold air supply module configured to communicate with an upper end of the evaporator cover module, the cold air supply module including a discharge port, and a blower fan. The cold air supply module includes a lower passage configured to communicate with the evaporator cover module, and an upper passage configured to communicate with the discharge port. The cold air supply module defines a communication hole at a position where the upper passage and the lower passage overlap each other, and the blower fan is located at the communication hole to cause suction of cold air from the heat-exchange space and discharge of cold air to the discharge port.

19 Claims, 18 Drawing Sheets

(56) References Cited

U.S. PATENT DOCUMENTS

| | | | | |
|---|---|---|---|---|
| 2009/0158767 | A1* | 6/2009 | McMillin | F25D 17/062 62/407 |
| 2012/0011879 | A1* | 1/2012 | Gu | F25D 23/069 62/408 |
| 2015/0121949 | A1* | 5/2015 | Heo | F25D 17/00 62/510 |
| 2015/0247662 | A1* | 9/2015 | Junge | F25D 11/02 62/443 |
| 2016/0153693 | A1* | 6/2016 | Oyu | F25D 17/045 62/276 |

* cited by examiner

REFRIGERATOR

CROSS-REFERENCE TO RELATED APPLICATIONS

The present application claims priority under 35 U.S.C. 119 and 35 U.S.C. 365 to Korean Patent Application No. 10-2017-0097152 (filed on Jul. 31, 2017), which is hereby incorporated by reference in its entirety.

BACKGROUND

The present disclosure relates to a refrigerator.

In general, refrigerators are home appliances for storing foods at a low temperature in a storage space that is covered by a door. For this, refrigerators cool the inside of the storage space by using cool air generated by being heat-exchanged with a refrigerant circulated through a refrigeration cycle to store foods in an optimum state.

In recent years, refrigerators have become increasingly multi-functional with changes of dietary lives and gentrification of products, and refrigerators having various structures and convenience devices for convenience of users and for efficient use of internal spaces have been released.

Also, in recent years, a built-in type refrigerator has been developed, in which the same panel as furniture or a wall surface is attached to a refrigerator door so as to have a sense of unity with the furniture or the wall surface within a space in which the refrigerator is disposed.

A built-in type refrigerator, particularly, a refrigerator in which cold air is supplied to a plurality of spaces by using one evaporator is disclosed in Korean Patent Publication No. 10-2006-0132770.

However, in the refrigerator having the above-described structure, in the case of a refrigerating compartment having a relatively large volume among a plurality of spaces, it is difficult to effectively perform cooling, and also, it is difficult to individually control a temperature of each space. Also, when the plurality of spaces are cooled through a single refrigeration cycle, an amount of refrigerant within the single refrigeration cycle increases to lead to limitations such as oversizing of the cycle and nonconformity of safety and environmental regulations.

When a plurality of fin-type evaporators are disposed, the storage space within the refrigerator may be reduced by the plurality of evaporators, and also, the storage space within the refrigerator may be further reduced due to placement of an independent fan, a motor, and the like.

SUMMARY

Embodiments provide a refrigerator that is capable of minimizing reduction of a storage space.

Embodiments also provide a refrigerator that is capable of independently and effectively cooling a plurality of storage spaces.

Embodiments also provide a refrigerator that is capable of minimizing penetration of a heat load in a built-in type refrigerator.

Embodiments also provide a refrigerator in which uniform cooling is enabled in an entire region within the refrigerator.

Embodiments also provide a refrigerator in which a roll bond evaporator is disposed to perform smooth defrost water discharge and cooling air flow.

In one embodiment, a refrigerator includes: a cabinet including an outer case defining an outer appearance and an inner case defining a storage space; a roll bond type evaporator disposed on one surface of the inner case; an evaporator cover module defining an inner wall of the storage space to provide a heat-exchange space, in which the evaporator is accommodated, and cold air flows, therein; a cold air supply module provided on a top surface of the inside of the storage space to communicate with an upper end of the evaporator cover module and provided with a discharge port through which the cold air is discharged toward the storage space; and a blower fan provided in the cold air supply module to circulate the cold air in the storage space, wherein the cold air supply module includes: a lower passage provided in a lower side to communicate with the evaporator cover module; and an upper passage provided in an upper side to communicate with the discharge port, wherein the blower fan is disposed in a communication hole in which the upper passage and the lower passage overlap each other to suction the cold air in the heat-exchange space and discharge the suctioned cold air through the discharge port.

The cold air supply module may include: a passage formation part provided with the upper passage and the lower passage, through which the cold air is suctioned and discharged by the blower fan; a lower case accommodating the passage formation part to cover the lower passage; and an upper case mounted on a top surface of the passage formation part to cover the upper passage.

The blower fan may have a structure in which the cold air is suctioned in a direction of a rotation shaft and discharged in a circumferential direction, and the rotation shaft may be disposed between the upper passage and the lower passage.

The rotation shaft may be disposed in a direction that crosses a top surface or bottom surface of the storage space.

The passage formation part may include: a lower part defining a lower portion of the passage formation part and connecting the lower passage between the blower fan and the evaporator cover module; and an upper part disposed above the lower part to define an upper portion of the passage formation part and providing the upper passage between the blower fan and the discharge port.

An inlet part further protruding backward from the lower part and coupled to an upper end of the evaporator cover module to allow the cold to be introduced may be disposed on the upper part, and a guide surface guiding a flow direction of the cold air introduced from the evaporator cover module to a forward direction may be further disposed inside the inlet part.

A lighting device mounting part on which a lighting device for brightening the inside of the refrigerator is mounted may be disposed on the lower part, and an outer surface of the lighting device mounting part may be rounded in a shape corresponding to the guide surface at a position corresponding to the inlet part to guide the flow of the cold air.

A front opening communicating with a front discharge port disposed on a front end of the cold air supply module may be defined in a front end of the passage formation part, and a side opening communicating with a side discharge port disposed on each of left and right ends of the cold air supply module may be defined in each of left and right ends of the passage formation part.

The upper part may be provided with a discharge guide surface, which is rounded or inclined to rear ends of both the side openings to each other while passing through a rear side of the blower fan and guides the cold air discharged from the blower fan to the front opening and the side opening.

A distribution part partitioning the front opening to distribute the discharged cold air may extend from the front opening.

The upper part may have a shape that is gradually widened forward, and the lower part may have a shape that is gradually widened backward.

A fan bracket covering the communication hole is mounted on the passage formation part, and the fan bracket may include: a shroud covering the communication hole and provided with an orifice by which air is introduced into the blower fan; and a bracket edge disposed along a circumference of the shroud and bent to come into contact with the discharge guide surface.

The refrigerator may further include a fan support extending upward from a circumference of the orifice and configured so that the blower fan is fixed and mounted at a position corresponding to the orifice.

An case mounting part stepped along a circumference of an opened top surface of the upper passage may be disposed on a top surface of the passage formation part, and the upper case may have a shape corresponding to the case mounting part to cover all the opened top surface of the upper passage and the blower fan.

The inner case may be provided by coupling at least one or more metal plates to each other.

The lower case may be provided with a base plate having the form of a plate made of the same material as the inner case and mounted on a bottom surface of the lower case to define an outer appearance of a bottom surface of the cold air supply module.

The evaporator cover module may include: a rear plate defining a rear wall of the storage space and provided with a suction hole through which the cold air within the storage space is suctioned;

a first insulation material attached to a rear surface of the rear plate to cover the roll bond evaporator at the front side; and a second insulation material spaced apart from the first insulation material and attached to the inner case to cover the roll bond evaporator at the rear side, wherein the heat-exchange space is defined between the first insulation material and the second insulation material.

A pair of side ducts defining both surfaces of the heat-exchange space and respectively coming into contact with both ends of the evaporator so that all the suctioned cold air passes through the evaporator may be disposed on a rear surface of the evaporator cover module.

The cabinet may include a refrigerating compartment and a freezing compartment, the roll bond evaporator may be disposed in the refrigerating compartment, and a fin type evaporator may be disposed in the freezing compartment.

The roll bond evaporator and the fin type evaporator may be respectively connected to compressors to constitute independent refrigeration cycles.

The details of one or more embodiments are set forth in the accompanying drawings and the description below. Other features will be apparent from the description and drawings, and from the claims.

DETAILED DESCRIPTION

Hereinafter, detailed embodiments of the present disclosure will be described in detail with reference to the accompanying drawings. However, the scope of the present disclosure is not limited to proposed embodiments, and other regressive inventions or other embodiments included in the scope of the spirits of the present disclosure may be easily proposed through addition, change, deletion, and the like of other elements.

Figure 1:
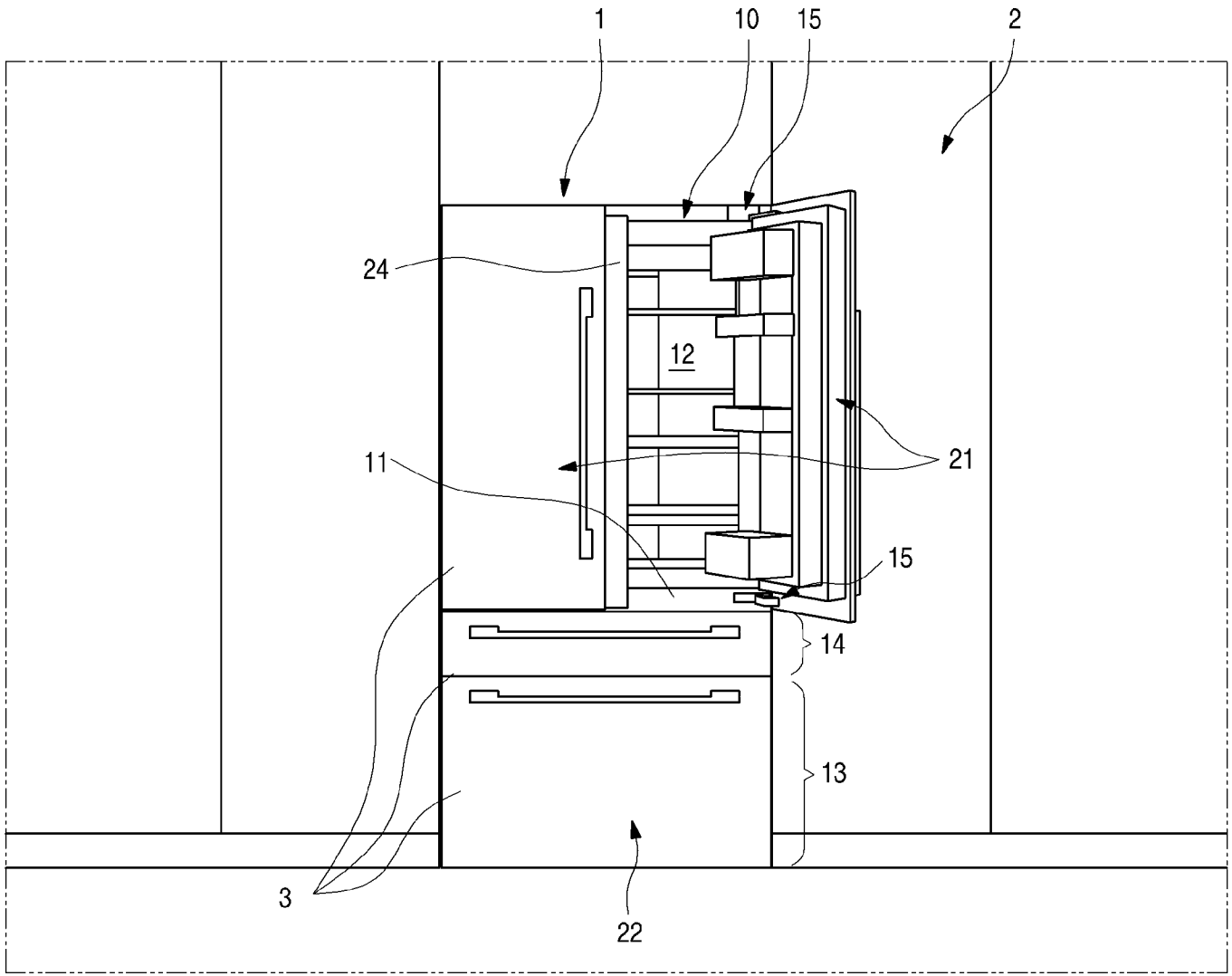
FIG. 1 is a view illustrating an installation state of a refrigerator according to an embodiment.
Figure 2:
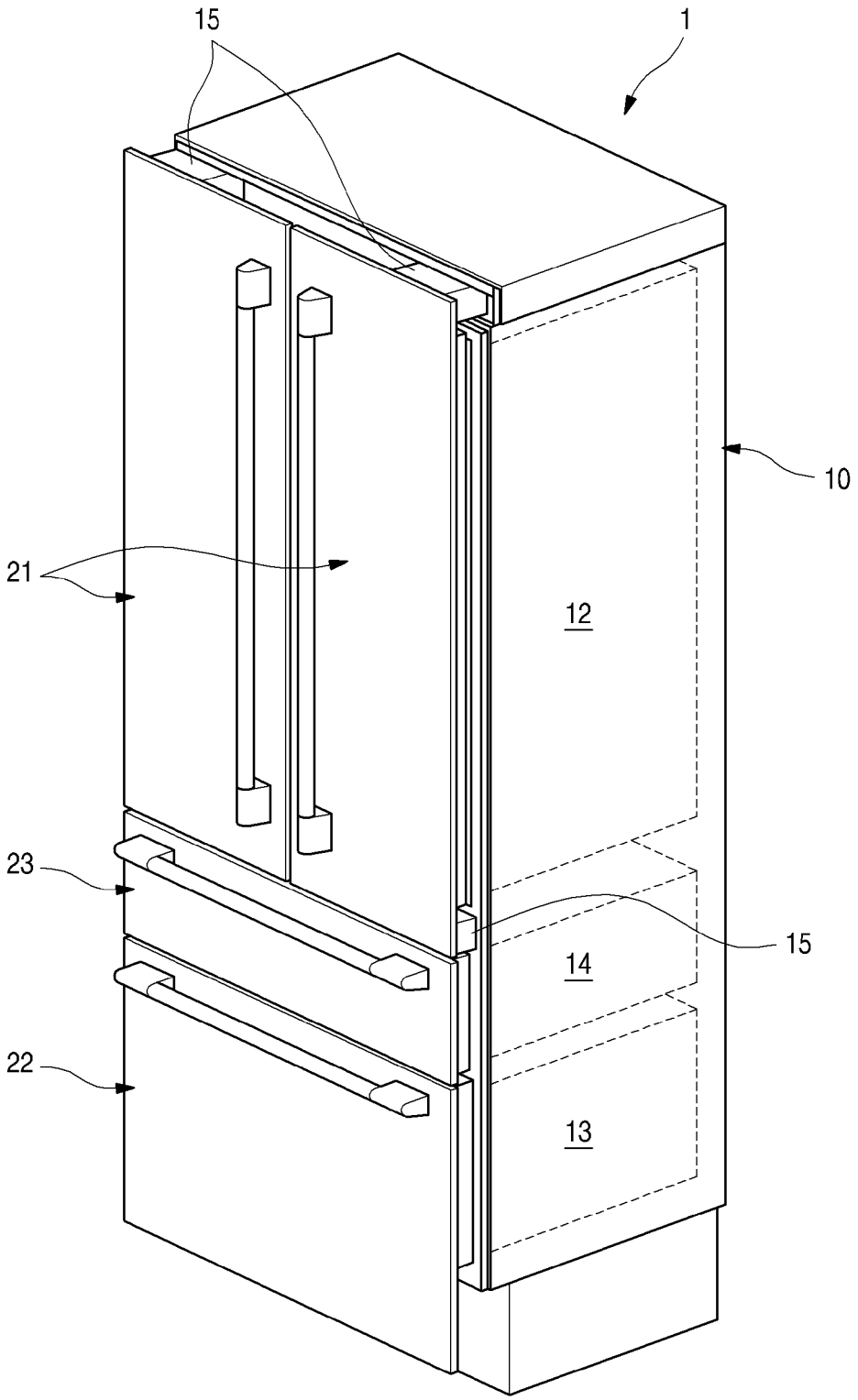
FIG. 2 is a perspective view of the refrigerator.
Figure 3:
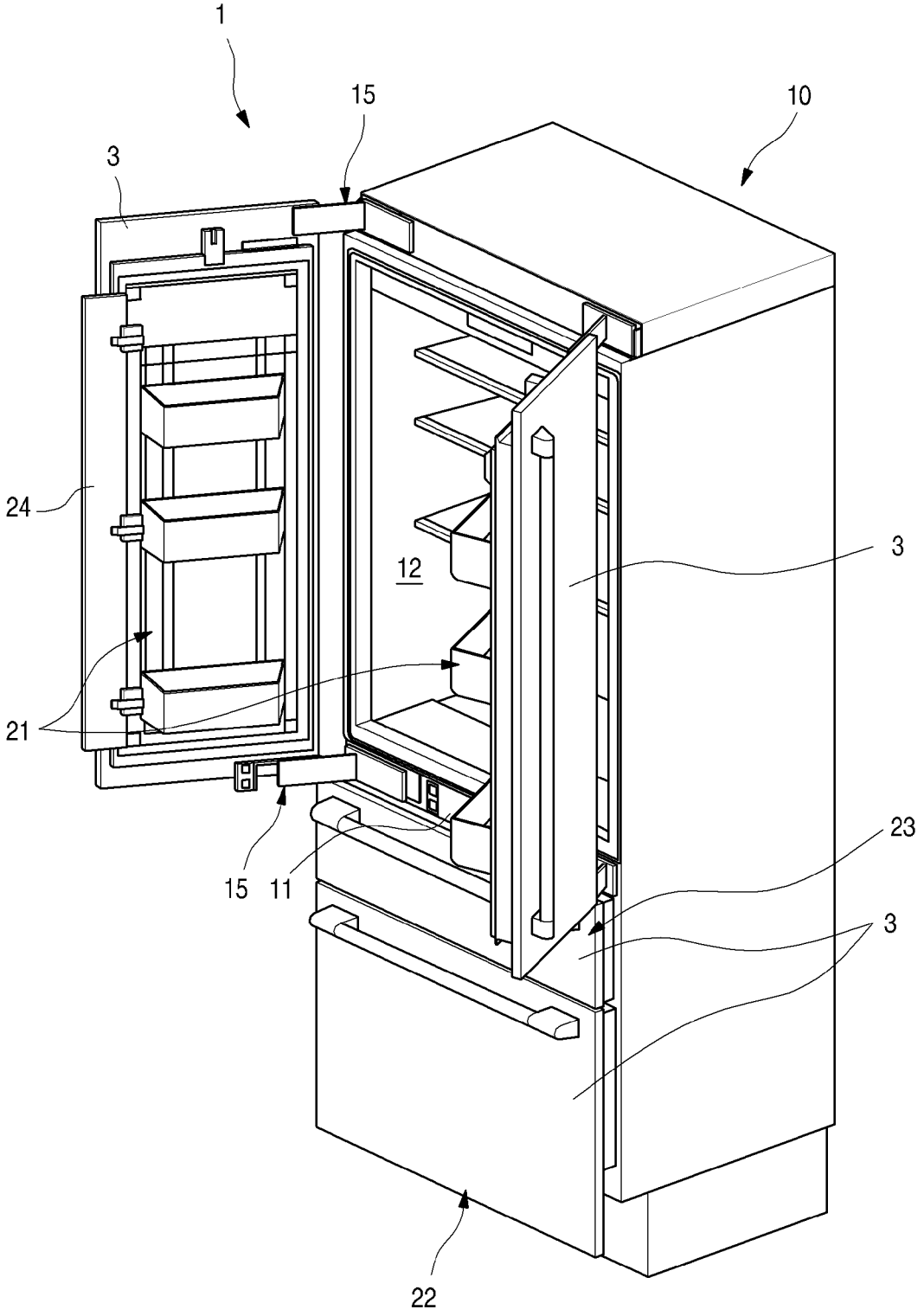
FIG. 3 is a perspective view illustrating a state in which a portion of doors of the refrigerator is opened.

FIG. 1 is a view illustrating an installation state of a refrigerator according to an embodiment. Also, FIG. 2 is a perspective view of the refrigerator. Also, FIG. 3 is a perspective view illustrating a state in which a portion of doors of the refrigerator is opened.

A refrigerator 1 according to an embodiment may be a built-in type refrigerator that is mounted with a sense of unity with furniture installed in an indoor space or between walls in which an exterior is provided.

As illustrated in FIG. 1, the refrigerator 1 may have a sense of unity with furniture 2 in the state of being installed. Thus, a front outer appearance of the refrigerator 1 may be formed by a panel 3 made of the same material or the same texture as the furniture. In the state in which the refrigerator 1 is installed, the panels 3 may be disposed to on the same plane as front surface of furniture 2 around the refrigerator 1.

The refrigerator 1 may have an outer appearance that is defined by a cabinet 11 defining a storage space and doors 21, 22, and 23 covering an opened front surface of the cabinet 11. The doors 21, 22, and 23 may be in a state in which the panel 3 is mounted. The panel 3 and the doors 21, 22, and 23 may be provided as separate parts.

The storage space may be divided into a plurality of spaces within the cabinet 11. As illustrated in the drawings, the storage space may include an upper refrigerating compartment 11, a lower freezing compartment 13, and a switching compartment between the refrigerating compartment 12 and the freezing compartment 13. The refrigerating compartment may be maintained at a temperature of a refrigerating region, and the freezing compartment 13 may be maintained at a below zero temperature for storing foods in a frozen state. Also, the switching compartment 14 may be switched into the refrigerating compartment 12 and the freezing compartment 13 according to a selective flow of cold air. As necessary, the switching compartment 14 may be maintained at a set temperature.

Of course, the present invention is not limited to the configuration of the storage space according to this embodiment, but may be applied to a refrigerator having various storage space configurations divided into at least two storage spaces.

The doors may include a refrigerating compartment door 21, a freezing compartment door 22, and a switching compartment door 23, which respectively independently open the storage spaces. The configurations of the doors may be variously provided to correspond to the configurations of the storage spaces.

For example, the refrigerating compartment door 21 may be provided in a pair to cover the refrigerating compartment 12. The refrigerating compartment doors 21 may be disposed on both left and right sides and rotatably connected to the cabinet 11 through hinge devices 15 to open and close the refrigerating compartment 12.

Both the left and right sides of the pair of refrigerating compartment doors 21 may be independently rotatably provided. Thus, the one refrigerating compartment 12 may be partially or wholly opened and closed by using the pair of refrigerating compartment door 21. The hinge devices 15 may be disposed on upper and lower ends of the refrigerating compartment door 21 so that the refrigerating compartment door 21 is rotatable. Since the refrigerator 1 is provided as the built-in type that is installed in the form of the furniture 2, the hinge devices may not interfere with the furniture 2, to which the panel 3 is adjacent, when the refrigerating compartment door 21 is opened and closed.

A covering device 24 may be disposed between the pair of refrigerating compartment doors 21. In the state in which the pair of refrigerating compartment doors 21 are closed, the covering device 24 may cover a gap between the pair of refrigerating compartment doors 21 to prevent cold air within the refrigerator 12 from leaking.

The freezing compartment door 22 and the switching compartment door 23 may be slidably inserted and withdrawn to open and close the freezing compartment 13 and the switching compartment 14. Also, an accommodation member may be coupled to the freezing compartment door 22 and the switching compartment door 23 to provide a structure as a drawer. The freezing compartment door 22 may be directly or indirectly coupled to the insertion/withdrawal device such as a rail disposed inside the cabinet 11 so as to be inserted and withdrawn like the drawer.

The panel 3 may be mounted on front surfaces of the refrigerating compartment door 21, the freezing compartment door 22, and the switching compartment door 23. Thus, when the refrigerator 1 is installed, the outer appearance of the refrigerator 1 may be defined by the panel 3. Also, in the state in which the panel 3 is attached to the front surfaces of the refrigerating compartment door 21, the freezing compartment door 22, and the switching compartment door 23, since a gap between the doors are very close to each other, the refrigerator 1 may be seen as a portion of the furniture 2.

Figure 4:
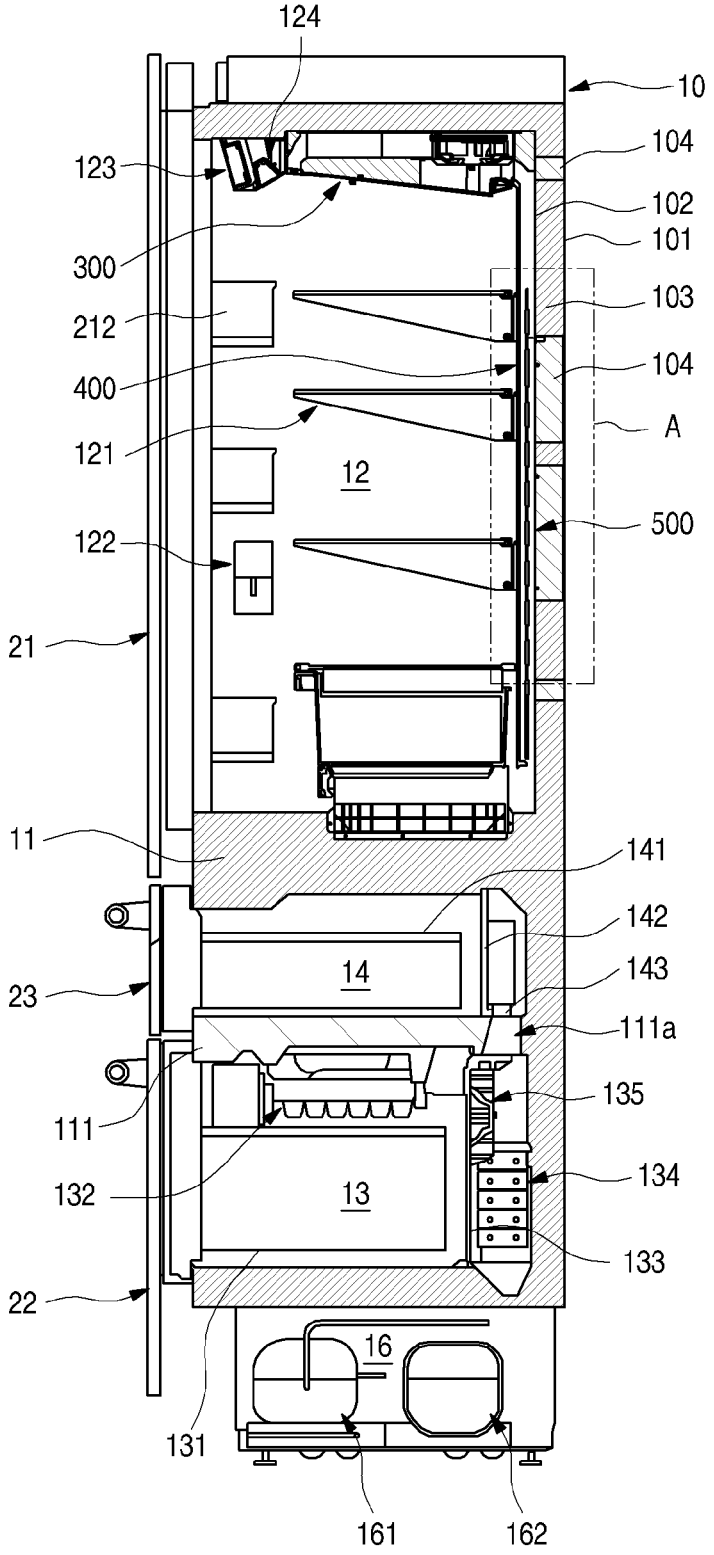
FIG. 4 is a cross-sectional view of the refrigerator.

FIG. 4 is a cross-sectional view of the refrigerator.

As illustrated in the drawing, the cabinet 11 may include an outer case 101 defining an outer surface thereof and an inner case 102 spaced apart from the outer case 101 to define an inner surface thereof. The inner case 102 may be made of a metal material such as stainless steel to define at least a portion of an inner surface of the refrigerator. Due to the arrangement of the inner case 102, when viewing the inside of the refrigerator 1, an elegant image may be displayed, and the inside of the refrigerator 1 may be more cooled.

Also, the entire region within the refrigerator 1 may be cooled through conduction. An insulation material 103 may be filled between the outer case 101 and the inner case 102 to insulate the inside of the refrigerator 1 from the outside of the refrigerator 1. Also, a spacer 104 mounted to support both sides of the inner case 102 and the outer case 101 before a foaming solution is injected to mold the insulation material 103 may be disposed between the inner case 102 and the outer case 101. The spacer 104 may maintain a predetermined distance between the inner case 102 and the outer case 101 to maintain the whole shape.

Two barriers 11 and 111 may be disposed on upper and lower portions of the cabinet 11 within the cabinet 11. The switching compartment 14 and the freezing compartment 13 may be partitioned by the barriers 11 and 111.

Also, a machine room 16 may be defined in a lower end of the cabinet 11, i.e., a lower side of the freezing compartment 13. Compressors 161 and 162 and a condenser (not shown), which constitute the refrigeration cycle, may be provided in the machine room 16. The compressors 161 and 162 may be provided in two, i.e., include a first compressor 161 constituting a first refrigeration cycle for cooling the freezing compartment 13 and a second compressor 162 constituting a second refrigeration cycle for cooling the refrigerating compartment 12. That is, the freezing compartment 13 and the refrigerating compartment 12 may be individually cooled by the independent refrigeration cycles, respectively.

As described above, the two refrigeration cycles may be separately provided to effectively independently cool the spaces. Also, the separated refrigeration cycles may be provided so that the compressors 161 and 162 are designed to have proper capacities, thereby reducing sizes, i.e., heights of the compressors 161 and 162. Thus, a volume occupied by the machine room 16 may be minimized to maximize a capacity of the storage space within the cabinet 11. In addition to, the refrigeration cycles may be separately provided to reduce an amount of refrigerant provided in each of the refrigeration cycles so that the refrigerant having explosiveness is more stably used.

A first evaporator 134 constituting the first refrigeration cycle may be disposed at a rear side of the freezing compartment 13. In general, the first evaporator 134 may be provided in a fin tube type. Thus, the fin tube may be called an evaporator. Also, a freezing compartment grill fan 133 may be disposed at a rear side of the freezing compartment, and the first evaporator 134 and a freezing compartment blower fan 135 may be provided in an inner space defined by the freezing compartment grill fan 133. The cold air within the freezing compartment evaporator 134 may be concentratedly supplied into the freezing compartment 13 by passing through the freezing compartment grill fan 133 by the freezing compartment blower fan 135.

A freezing compartment drawer 131 that is capable of being inserted and withdrawn together with the freezing compartment door 22 may be provided in the freezing compartment door 13. Also, an ice maker 132 for making ice may be provided in the freezing compartment 13.

A switching compartment drawer 141 that is capable of being inserted and withdrawn together with the switching compartment door 23 may be provided in the switching compartment 14. A switching compartment grill fan 142 may be provided at a rear side of the switching compartment 14. Also, a switching compartment duct 111*a* communicating with a space in which the first evaporator 134 is disposed may be provided at a rear side of the switching compartment grill fan 142. The switching compartment duct 111*a* may provide a passage so that the cold air of the first evaporator 134 is introduced into the switching compartment 14.

A damper 143 may be provided in the switching compartment duct 111*a*. The damper 143 may be configured to open and close the switching compartment duct 111*a*. The supply of the cold air into the switching compartment 14 may be selectively adjusted according to a degree of opening of the damper 143 or the opening/closing of the damper 143. Thus, the inside of the switching compartment 14 may be maintained at a set temperature by the damper 143. A switching compartment blower fan (not shown) may be further provided in a space defined by the switching compartment duct 111*a* or the switching compartment grill fan 142. The supply of the cold air into the switching compartment 14 may be more effectively performed by the switching compartment blower fan. Also, the switching compartment blower fan may be interlocked with the operation of the damper 143. Alternatively, the switching compartment 14 may have a separate independent cooling structure by a thermoelectric element or a refrigeration cycle.

The evaporator cover module 400 may be disposed on the rear surface of the refrigerating compartment 12. The evaporator cover module 400 may be disposed on the rear surface of the refrigerating compartment 12. Also, a space in which the second evaporator 500 is disposed may be defined between the evaporator cover module 400 and the rear surface of the inner case 102. The second evaporator 500 may have a plate shape as the roll bond type evaporator. Thus, the second evaporator 500 may be called a roll bond evaporator or a plate-type evaporator. The second evaporator 500 may be disposed between the evaporator cover module 400 and the inner case 102 to cool air flowing along the space in which the second evaporator 500 is accommodated.

A cold air supply module 300 may be disposed on the top surface of the refrigerating compartment 12. The refrigerating compartment blower fan 370 may be provided in the cold air supply module 300 to forcibly supply the cold air within the refrigerating compartment 12. Also, the cold air supply module 300 may be connected to the evaporator cover module 400, and air within the refrigerating compartment 12 may be cooled by passing through the inside of the evaporator cover module 400 and then be supplied to the refrigerating compartment 12 through the cold air supply module 300.

A display module 123 for displaying an operation state of the refrigerator 1 may be further disposed on the top surface of the refrigerating compartment 12. Lighting devices 124 and 125 for brightening the inside of the refrigerator 1 may be further provided in the display module 123 and the cold air supply module 300.

A plurality of shelves and drawers may be provided in the refrigerating compartment 12. A door basket 212 may be disposed on the rear surface of the refrigerating compartment door 21 to provide various accommodation spaces in the refrigerator 1.

Figure 5:
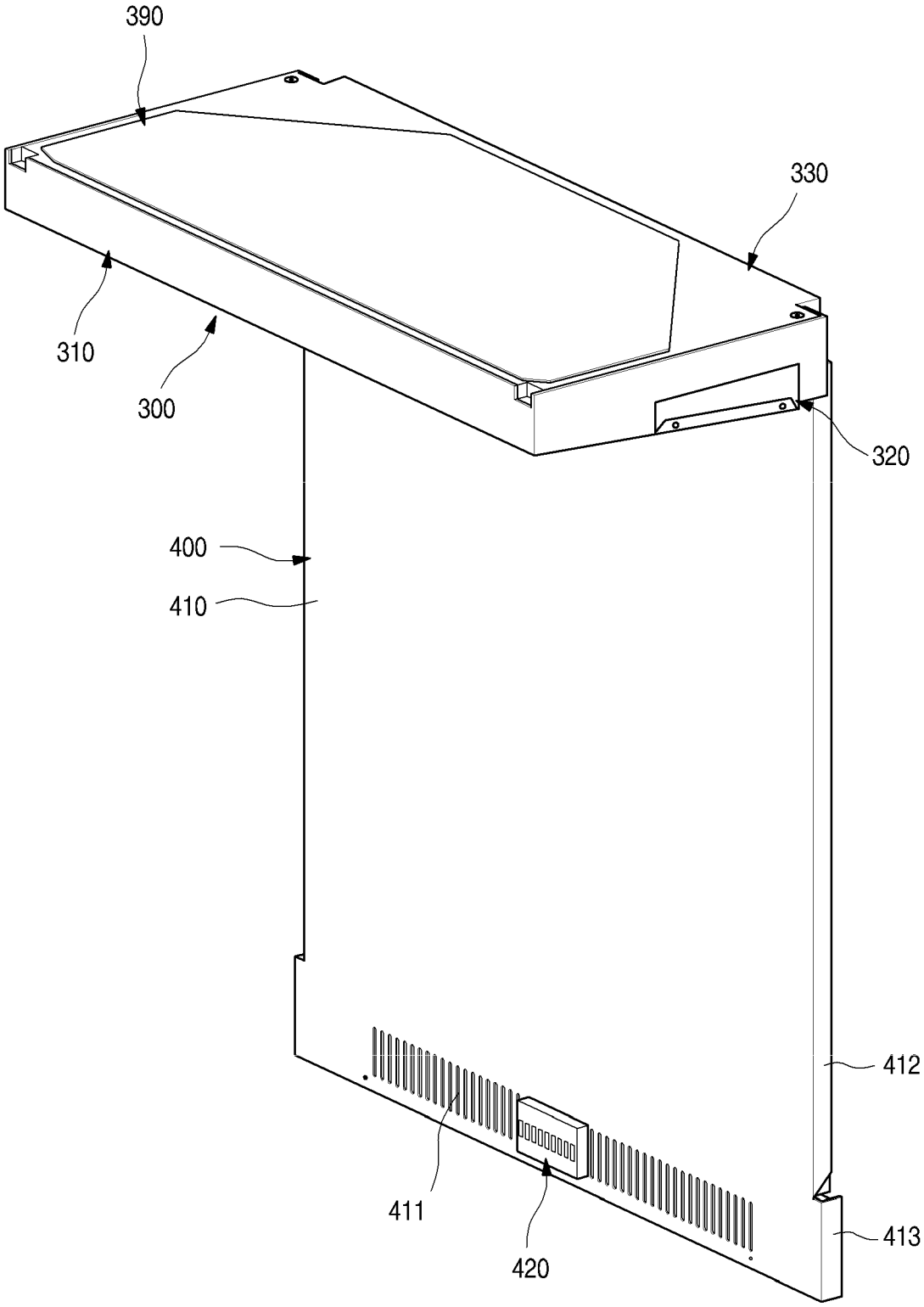
FIG. 5 is a perspective view illustrating a state in which a cold air supply module and an evaporator cover module are coupled to each other according to an embodiment.
Figure 6:
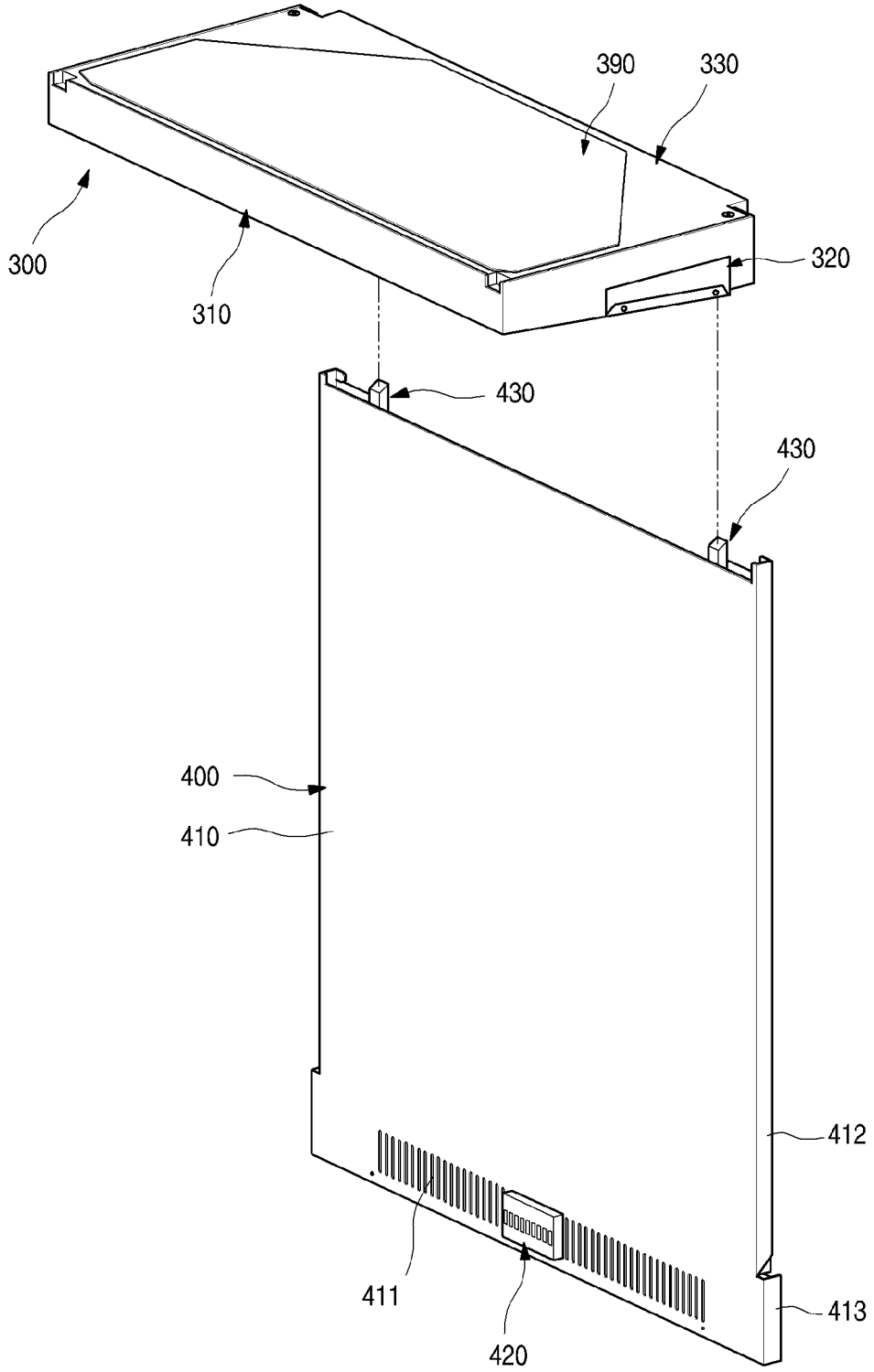
FIG. 6 is an exploded perspective view illustrating a coupling structure between the cold air supply module and the evaporator cover module.

FIG. 5 is a perspective view illustrating a state in which the cold air supply module and the evaporator cover module are coupled to each other according to an embodiment. Also, FIG. 6 is an exploded perspective view illustrating a coupling structure between the cold air supply module and the evaporator cover module.

As illustrated in the drawings, the cold air supply module 300 be coupled to the evaporator cover module 400 to communicate with the passage into which the cold air is supplied. Also, the cold air supply module 300 may be disposed on an upper end of the refrigerating compartment 12 to define an outer appearance of at least a portion of the top surface of the refrigerating compartment 12. The evaporator cover module 400 may be disposed on the rear surface of the refrigerating compartment 12 to define an outer appearance of at least a portion of the rear surface of the refrigerating compartment 12.

The evaporator cover module 400 may be coupled to a rear end of a bottom surface of the cold air supply module 300. In this state, the evaporator cover module 400 may define the top and rear surfaces of the refrigerating compartment 12. Also, the evaporator cover module 400 and the cold air supply module 300 may communicate with each other. Thus, the cold air may flow along the evaporator cover module 400 and the cold air supply module 300.

The evaporator cover module 400 may have a size corresponding to that of the rear surface of the refrigerating compartment 12, and a suction hole 411 may be defined in the evaporator cover module 400 to allow the air within the refrigerating compartment 12 to be introduced into the evaporator cover module 400. Also, a space in which the second evaporator 500 is accommodated may be provided in the evaporator cover module 400.

The cold air supply module 300 may have a size corresponding to that of the top surface of the refrigerating compartment 12, and a refrigerating compartment blower fan 370 may be provided in the cold air supply module 300. The refrigerating compartment blower fan 370 may be disposed at a rear side that is adjacent to the evaporator cover module 400. Thus, the cold air supply module 300 may have a shape having a thickness that gradually increases from the front side to the rear side. Also, a plurality of discharge ports 317 and 318 may be disposed on the bottom surface of the cold air supply module 300 to discharge the cold air guided through the cold air supply module 300 to the inside of the refrigerating compartment 12.

The cold air supply module 300 may be mounted on the top surface of the refrigerating compartment 12 in the state in which the evaporator cover module 400 is mounted inside the refrigerating compartment 12. The rear end of the bottom surface of the cold air supply module 300 and the upper end of the evaporator cover module 400 may communicate with each other by the mounting of the cold air supply module 300.

Hereinafter, a structure of the cold air supply module will be described in more detail with reference to the accompanying drawings.

Figure 7:
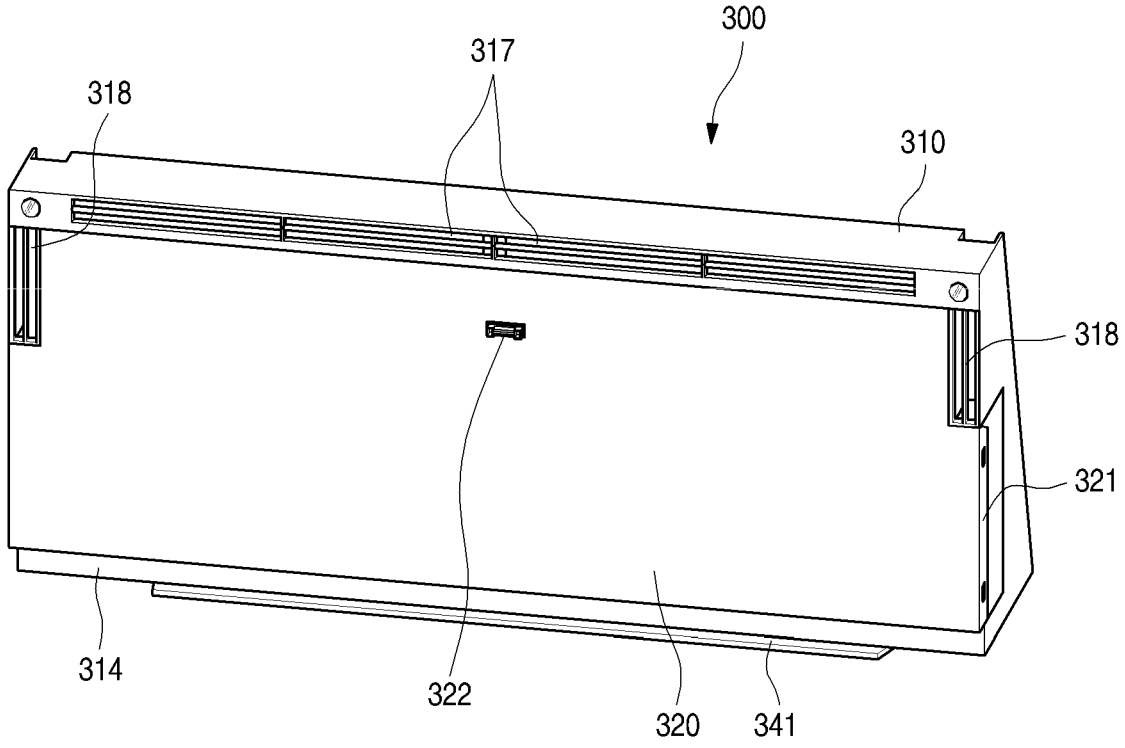
FIG. 7 is a perspective view when viewed from a lower side of the cold air supply module.
Figure 8:
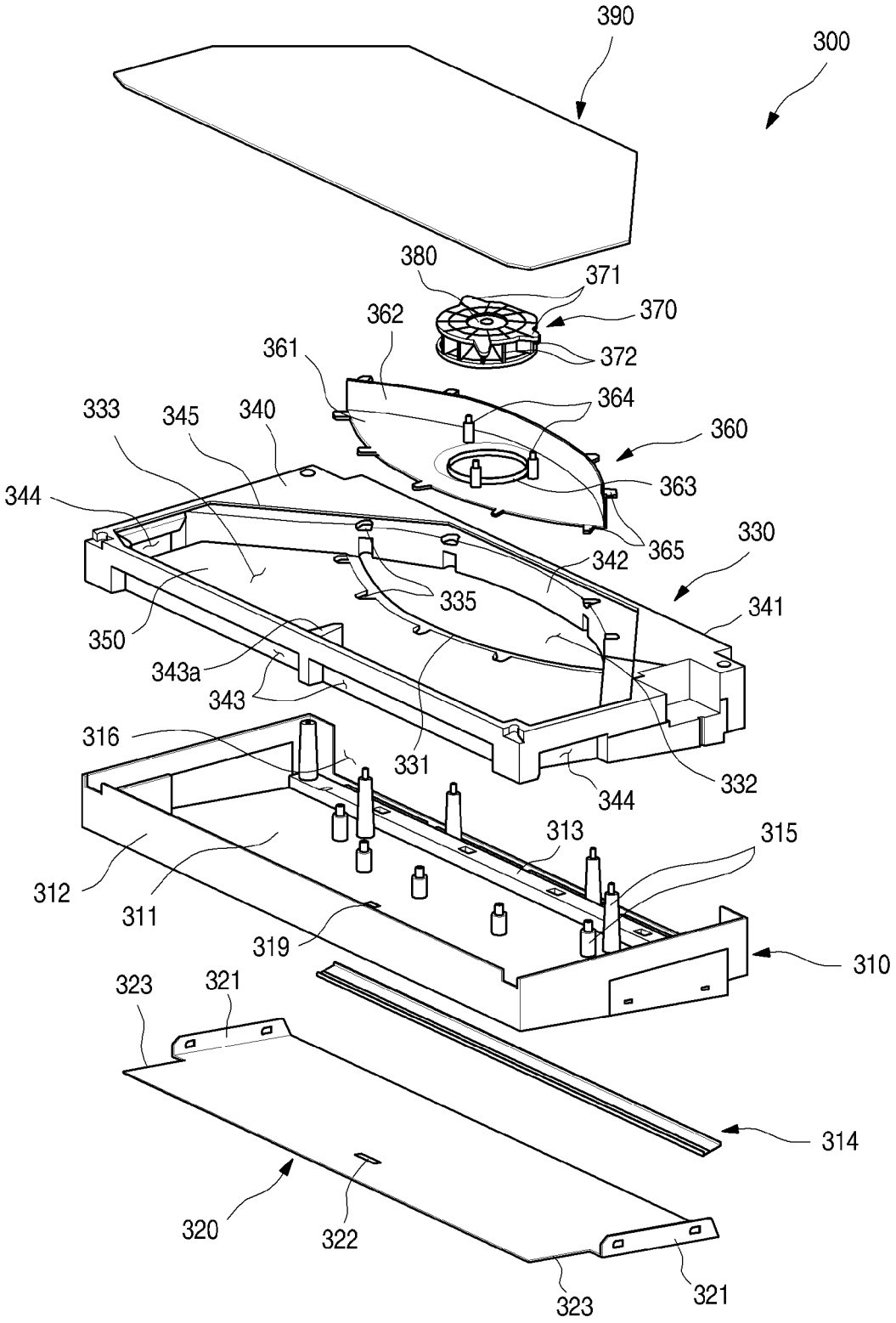
FIG. 8 is an exploded perspective view of the cold air supply module when viewed from a front side.
Figure 9:
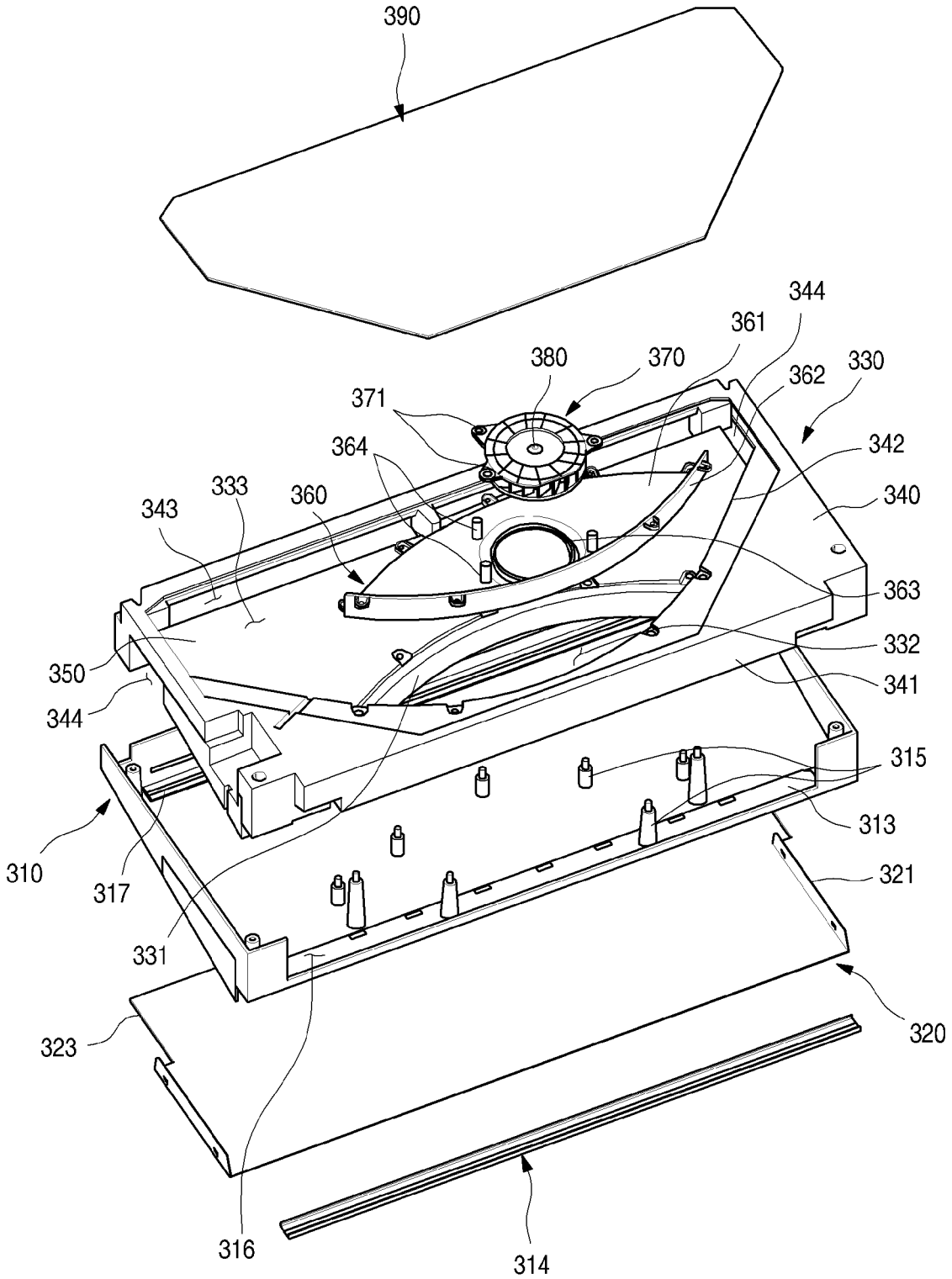
FIG. 9 is an exploded perspective view of the cold air supply module when viewed from a rear side.

FIG. 7 is a perspective view when viewed from a lower side of the cold air supply module. FIG. 8 is an exploded perspective view of the cold air supply module when viewed from a front side. FIG. 9 is an exploded perspective view of the cold air supply module when viewed from a rear side.

As illustrated in the drawings, the cold air supply module 300 may include a lower case 310 and an upper case 390, which define an outer appearance thereof, and a passage formation part 30 between the upper case 390 and the lower case 310.

The lower case 310 may be injection-molded by using a plastic material and include a base 311 defining a bottom surface thereof and edges 312 extending upward from both side surfaces and front surface of the base 311.

Discharge ports 317 and 318 through which the cold air is discharged may be disposed on a front end and both side ends of the base 311, respectively. The discharge ports 317 and 318 may include a front discharge port 317 disposed on a front end of the base 311 and side discharge ports 318 disposed on both side ends of the base 311. Each of the front discharge port 317 and the side discharge ports 318 may have a grill shape.

The front discharge port 317 may lengthily extend from one end to the other end of the front end of the base 311. Thus, the cold air discharged from the front discharge port 317 may be supplied downward from the front end of the top surface of the refrigerating compartment 12.

The side discharge ports 318 may be disposed on both the side ends of the base 311, i.e., the front portion of the base 311. That is, the side discharge ports 318 may respectively extend backward from both ends of the front discharge port 317 up to an approximately central point of the base 311. Thus, the side discharge ports 318 may be provided downward from front portions of both side ends of the top surface of the refrigerating compartment 12, respectively.

A base plate 320 may be mounted on the base 311. The base plate 320 may be made of the same material as the inner case 102 and have a plate shape to define an outer appearance of the bottom surface of the cold air supply module 300 exposed to the inside of the refrigerating compartment 12.

The base plate 320 may be made of a plate-shaped stainless material. An area of the base plate 320, which corresponds to the front discharge port 317 and the side discharge ports 318, may be cut. Thus, when the base plate 320 is mounted on the base, the base plate 320 may define the top surface of the refrigerating compartment 12. Here, the front discharge port 317 and the side discharge ports 318 may be exposed.

A bent part 321 may be disposed on each of both ends of the base plate 320. The bent part 321 may be coupled to an edge of the base 311 to firmly maintain the coupled state between the base plate 320 and the base 311. A rear end of the base plate 320 may extend up to a light cover 314 that will be described below. Also, a sensor hole 322 may be defined in a side of a center of the base plate 320.

A sensor mounting part 319 may be disposed on a side of the base 311, which corresponds to the sensor hole 322. The sensor mounting part 319 may be configured so that a temperature sensor for measuring an inner temperature of the refrigerating compartment 12 is mounted.

A plurality of supporting bosses 315 extending upward may extend inside the base 311. The supporting bosses 315 may pass through the passage formation part 330 and then be coupled to a fan bracket 360 that will be described below. The supporting bosses 315 may support the fan bracket 360 and be provided in plurality along a circumference of the fan bracket 360.

The passage formation part 330 may be filled into the base 311 and mounted on the base 311 to provide a flow passage for the cold air. The passage formation part 330 may be made of a Styrofoam material having an insulation property and be mounted on the base 311 in the state in which the passage formation part 30 is molded.

The passage formation part 330 may include an upper part 340 and a lower part 350 as a whole. The upper part 340 may define an upper portion of the passage formation part 330 and be filled into an upper space of the base 311. Also, the lower part 350 may define a lower portion of the passage formation part 330 and be filled into a lower space of the base 311. Thus, when the passage formation part 330 is mounted on the lower case 310, an upper passage 333 and a lower passage may be provided. The upper passage 333 and the lower passage 332 may communicate with each other by a communication hole 331.

In detail, the upper part 340 may define an upper circumference of the passage formation part 330 to provide the upper passage 333 that is opened upward.

A rear end of the upper part 340 may further protrude than a rear end of the base 311. Thus, an inlet part 341 may be disposed between the rear end of the base 311 and the upper part 340. The opened upper end of the evaporator cover module 400 may be inserted into or come into contact with the inlet part 341. Thus, the cold air flowing upward along the evaporator cover module 400 may be introduced into the passage formation part 330. Also, the inlet part 341 may have a rounded bottom surface. Thus, the cold air vertically flowing upward may flow along a rounded guide surface 341*a* of the inlet part 341 and then be guided in a direction crossing the evaporator cover module 400.

A discharge guide surface 342 may be disposed on the upper part 340. The discharge guide surface 342 may guide the cold air blown by the refrigerating compartment blower fan 370 to allow the cold air to flow to the front discharge port 317 and the side discharge ports 318. The discharge guide surface 342 may define a rear surface of the upper passage 333 and have a predetermined curvature to connect the rear ends of the side discharge ports, which are disposed on both the sides, to each other. Here, the discharge guide surface 342 may be disposed at a rear side of the refrigerating compartment blower fan 370. Also, a portion of the discharge guide surface 342 may define a portion of the communication hole 331.

A front opening 343 may be defined in a front end of the upper part 340. The front opening 343 may define a front end of the upper passage 333 and be defined at a corresponding position to communicate with the front discharge port 317. A distribution part 343*a* for dispersing air passing through the front opening 343 may extend backward from an approximately central portion of the front opening 343. The distribution part 343*a* may be configured to partition the front opening 343 and have both inclined side surfaces.

Also, a side opening 344 may be defined in each of both side ends of the upper part 340. The side opening 344 may define a portion of both side ends of the upper passage 333 and be defined at a corresponding position to communicate with each of the side discharge ports 318.

The lower part 350 may define a lower of the passage formation part 330. That is, the lower part 350 may provide a passage through which the cold air introduced into the cold air supply module 300 is discharged to the front discharge port 317 and the side discharge ports 318 via the refrigerating compartment blower fan 370.

In detail, the lower part 350 may be disposed at a position corresponding to a space of the upper passage 333 and be filled into a space between the upper part 340 and the base 311. Thus, in the state in which the passage formation part 330 is mounted, a top surface of the lower part 350 may define the upper passage 33, and a bottom surface of the lower part 350 may come into contact with the base 311 and be filled into the lower case 310.

Here, a front end and both side ends of the lower part 350 may extend up to the front opening 343 and the side openings to provide passages through which the front opening 343 communicates with the front discharge port 317, and the side openings 344 communicates with the side discharge ports 318.

Also, the rear end of the lower part 350 may define a front portion of the communication hole 331. The rear end of the lower part 350 may be recessed forward in a rounded shape to define a portion of the lower passage 332.

The communication hole 331 may be defined by the rear end of the lower part 350 and the discharge guide surface 342. The communication hole 331 may have a shape of which a width gradually decreases from a center thereof in both side directions, and both ends come into contact with each other. The communication hole 331 may have a size, in which the refrigerating compartment blower fan 370 is accommodated in a center thereof.

A boss hole 335 through which the supporting boss 315 passes may be defined along the communication hole 331. An upper end of the supporting boss extending upward by passing through the boss hole 335 may be coupled to the fan bracket 360 through a screw.

The fan bracket 360 may be mounted to cover the communication hole 331. The fan bracket 360 may include a shroud 361 having a shape corresponding to the communication hole 331 and a bracket edge 362 defining a circumference of the shroud 361.

A plurality of bracket coupling parts 365 may be disposed along the outside of the shroud 361. The bracket coupling part 365 may be disposed at a position corresponding to a boss hole 335 defined in the lower part 350 and coupled to an upper end of the supporting boss 315 passing through the boss hole 335.

An orifice 363 may be defined in a center of the shroud. The orifice 363 may be disposed at a position corresponding to the refrigerating compartment blower fan 370 and substantially serve as a suction passage for air. Thus, a circumference of the orifice 363 may extend in the same shape as a bell mouth so that air is more smoothly suctioned.

A fan support 364 may be disposed outside the orifice 363. The fan support 364 may support the refrigerating compartment blower fan 370 and be coupled to a blower fan coupling part 371.

Although not shown in detail, a fan motor 380 having a turbo fan structure may be mounted at a center of the refrigerating compartment blower fan 370 so that air is suctioned in a shaft direction and discharged in a circumferential direction. Also, a plurality of blades 372 may be disposed on the refrigerating compartment blower fan 370 in the circumferential direction. Thus, the air within the lower passage, which is suctioned through the orifice 363, may be discharged into the upper passage 333 while being discharged in the circumferential direction by the refrigerating compartment blower fan 370.

The bracket edge 362 may extend along a rear end of the shroud from the fan bracket 360. The bracket edge 362 may be closely attached to the discharge guide surface 342. Also, the bracket coupling part 365 that vertically protrudes may be disposed along an upper end of the bracket edge 362. The bracket coupling part 365 may be coupled to an upper end of the supporting boss 315 extending by passing through the upper part 340.

The fan bracket 360 and the refrigerating compartment blower fan 370 may not protrude to the outside of the passage formation part 330 in the state of being accommodated in the upper passage 333 and be covered by the upper case 390.

The upper case 390 may define the top surface of the cold air supply module 300 and cover the opened top surface of the passage formation part 330. In the state in which the upper case 390 is mounted, the upper case 390 may cover the upper passage 333 and also cover the fan bracket 360, which is disposed on the upper passage 333, and the refrigerating compartment blower fan 270.

Also, an case mounting part 345 that is recessed in a space corresponding to the upper case 390 may be disposed on the top surface of the passage formation part 330. In the state in which the upper case 390 is mounted, the top surface of the upper case 390 may have the same plane as the top surface of the passage formation part 330 on the case mounting part 345.

When the cold air supply module 300 is mounted inside the refrigerating compartment 12, the top surfaces of the upper case 390 and the passage formation part 330 may come into contact with the top surface of the inner case 102. Also, both left and right ends of the cold air supply module 300 may come into contact with both left and right surfaces of the inner case 102. Also, a rear end of the cold air supply module 300, more particularly, the inlet part 341 may come into contact with the evaporator cover module 400 to provide a passage through which the cold air flows.

Hereinafter, the evaporator cover module 400 will be described in with reference more detail to the drawing.

Figure 10:
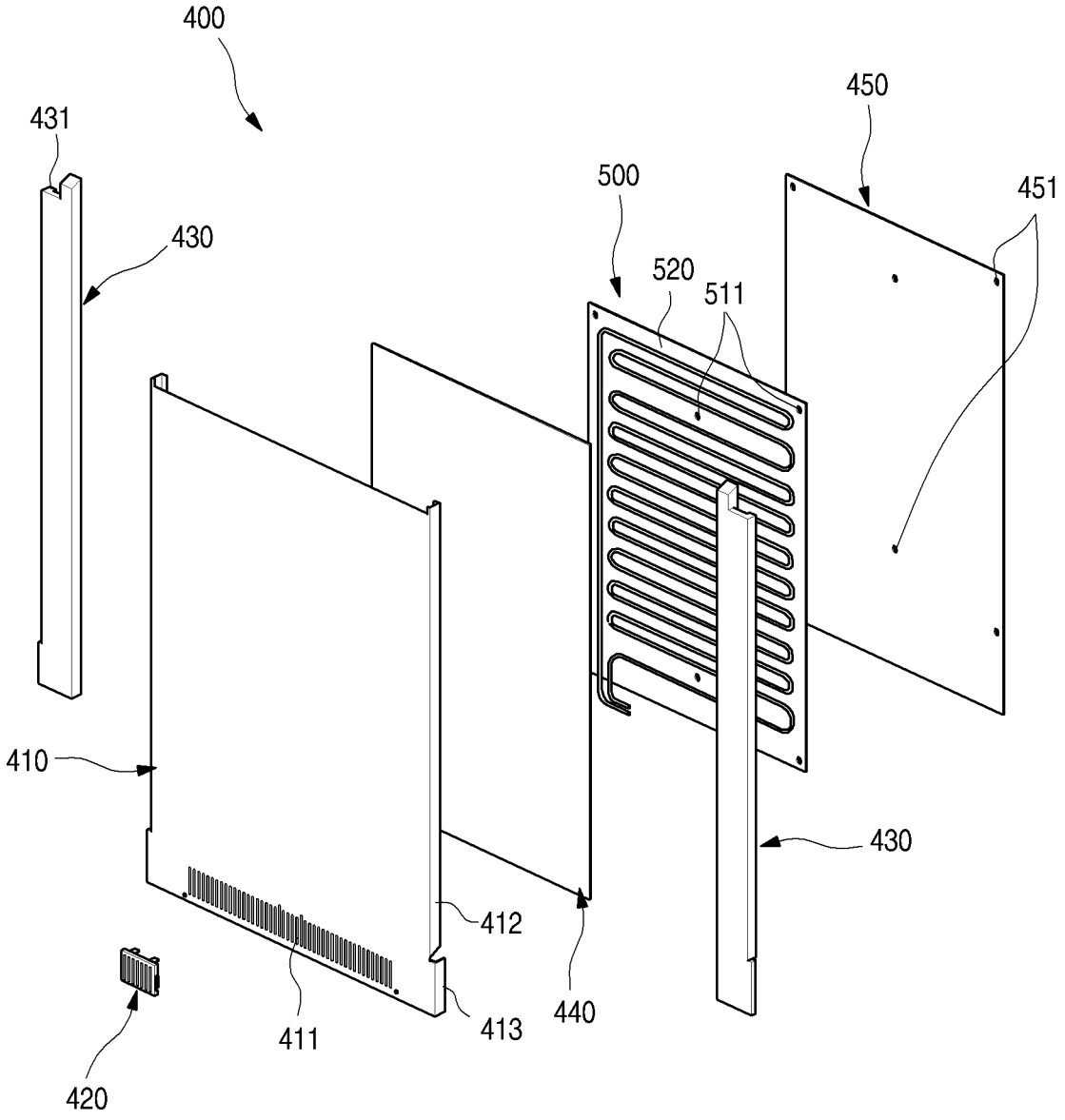
FIG. 10 is an exploded perspective view illustrating a coupling structure between the evaporator cover module and a roll bond evaporator when viewed from the front side.
Figure 11:
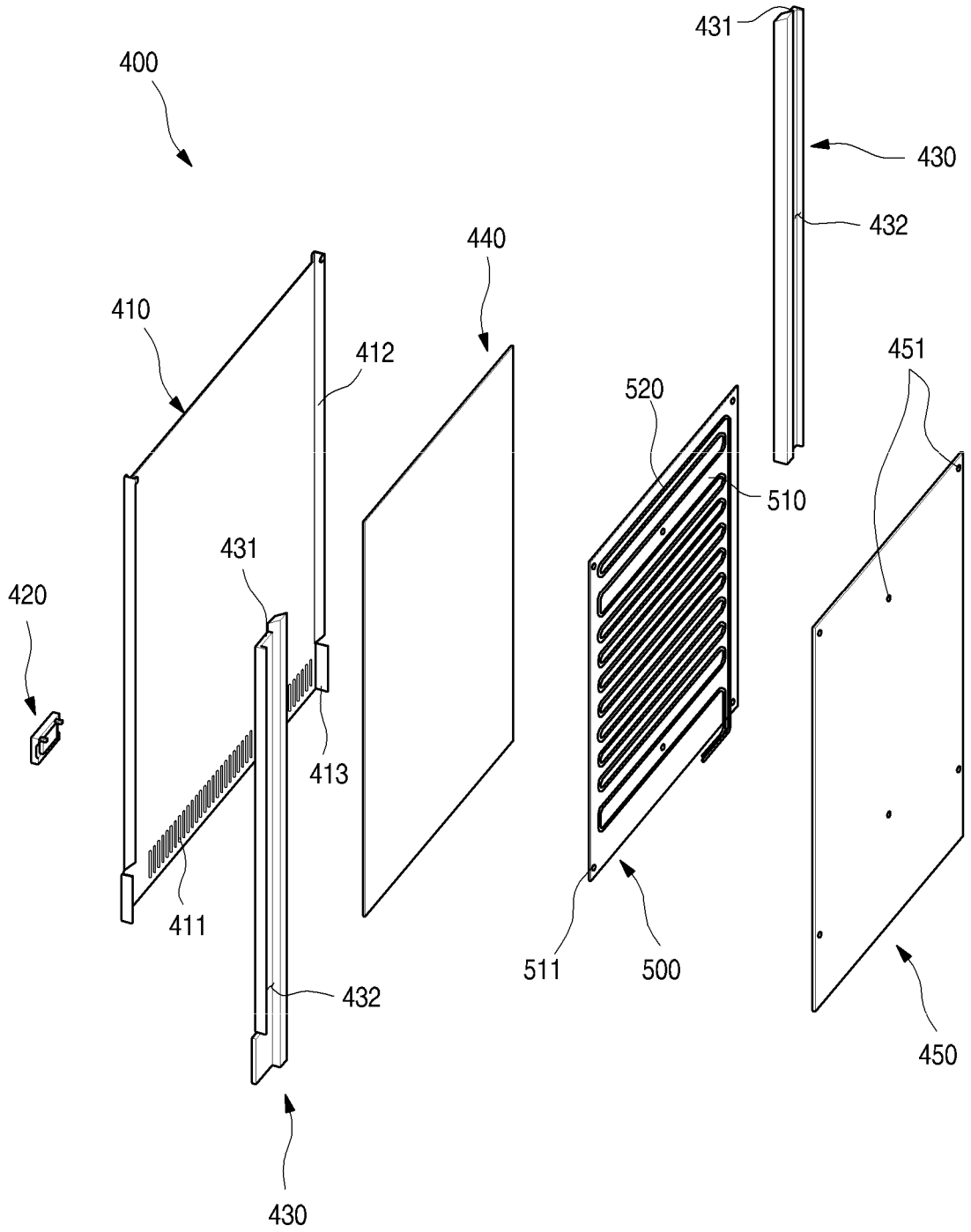
FIG. 11 is an exploded perspective view of the coupling structure between the evaporator cover module and the roll bond evaporator when viewed from the rear side.

FIG. 10 is an exploded perspective view illustrating a coupling structure between the evaporator cover module and the roll bond evaporator when viewed from the front side. Also, FIG. 11 is an exploded perspective view of the coupling structure between the evaporator cover module and the roll bond evaporator when viewed from the rear side.

As illustrated in the drawing, the evaporator cover module 400 may be disposed on an inner rear surface of the refrigerating compartment 12. The evaporator cover module 400 may define the rear surface of the refrigerating compartment 12 and also provide a space in which the second evaporator 500 is mounted and a cold air flow space.

The evaporator cover module 400 may include the rear plate 410, a first insulation material, a second insulation material 450, and side ducts 430.

In detail, the rear plate 410 may define an outer appearance of the evaporator cover module 400, i.e., define the rear surface of the refrigerating compartment 12. The rear plate 410 may be made of a metal material such as stainless steel like the inner case 102.

A suction hole 411 may be defined in a lower portion of the rear plate 410. The suction hole 411 may be defined by a plurality of holes passing through the rear plate 410 and have a grill shape.

An air purification module 420 may be mounted on the suction hole 411. The air purification module 420 may be configured to purify air by using a filter or a catalyst and be detachably disposed on the suction hole 411.

The rear plate 410 may be made of a plate-shaped material and have both side surfaces that are bent to define a heat-exchange space 460 in which the rear plate 410 is spaced apart from the rear surface of the inner case 102. The heat-exchange space 460 may be a space between the first insulation material 440 and the second insulation material 450 and also be defined as a space in which the second evaporator 500 is disposed.

In detail, an upper bent part 321 and a lower bent part 321 may be disposed on both side ends of the rear plate 410. The upper bent part 321 may be bent backward so that both bent ends of the upper bent part 321 are spaced apart from the inner case 102. Thus, a shelf mounting member (not shown) on which shelves 121 disposed in the refrigerating compartment 12 are mounted may be disposed between the upper bent part 321 and the side surface of the inner case 102. Although not shown, the shelf mounting member may extend in a vertical direction, and a plurality of mounting holes may be vertically defined in the shelf mounting member. Thus, the user may mount the cantilever type shelf 121 at a desired height.

The lower bent part 321 may be bent backward, i.e., be bent backward in a state of coming into contact with both side surfaces of the inner case 102. Thus, a width between the upper bent parts 321 may be less than that between the lower bent parts 321. That is, an outer surface of the lower bent part 321 may further protrude outward from an outer surface of the upper bent part 321. Here, a protruding distance may correspond to a protruding distance of the shelf mounting member.

Also, the lower bent part 321 may have a height that is determined depending on a length of the shelf mounting member. The lower bent part 321 may extend from a lower end of the shelf mounting member to a lower end of the rear plate 410.

The side ducts 430 may be disposed on both inner left and right sides of the rear plate 410. The side ducts 430 may cover both left and right sides in the rear space of the rear plate 410 to define a space, in which the second evaporator 500 is disposed, between both the left and right sides.

Each of the side ducts 430 may be made of an insulation material such as foaming foam. In a state in which the side ducts 430 are molded, the side ducts 430 may be assembled and mounted on the rear plate 410. Also, the side ducts 430 may be fixed and mounted inside the refrigerating compartment 12 in a state in which all the rear plate 410 and the first insulation material 440 are coupled.

A distance between the side ducts 430 disposed on both left and right sides may correspond to a width of the second evaporator 500. A rear space of the rear plate 410, which is defined by the side ducts 430, may have a horizontal width correspond to that of the second evaporator 500. Thus, air passing through the heat-exchange space 460 may be effectively cooled by passing through the second evaporator 500.

The side ducts 430 may vertically extend along the rear plate 410 and have one side having a shape corresponding to each of the upper bent part 321 and the lower bent part 321 of the rear plate 410 and the other side defining a side surface of the heat-exchange space 460 in which the second evaporator 500 is accommodated.

A vertically extending duct pass 432 may be disposed on a rear surface of each of the side ducts 430. The duct pass 432 may be recessed from an upper end to a lower end of the side duct 430 and provided so that a water supply tube or wires, which are guided to the refrigerating compartment 12, are disposed.

The side duct 430 may have a thickness corresponding to a height of each of the upper bent part 321 and the lower bent part 321 and come into contact with the inner case 102 to define a space in which the second evaporator 500 is disposed.

A duct coupling part 431 that is stepped may be disposed on an upper end of the side duct 430. The duct coupling part 431 may be inserted into the inside of the inlet part 341 of the passage formation part 330 when the cold air supply module 300 and the evaporator cover module 400 are coupled to each other. Thus, the cold air supply module 300 and the evaporator cover module 400 may be maintained in the state in which the cold air supply module 300 and the evaporator cover module 400 are coupled to each other within the refrigerating compartment 12, and also, the passages between the cold air supply module 300 and the evaporator cover module 400 may communicate with each other.

The first insulation material 440 may be disposed on the rear surface of the rear plate 410. The first insulation material 440 may have a plate shape and made of an insulation material having a thin thickness. The first insulation material 440 may be made of a vacuum insulation material or a high-density foam material.

The first insulation material 440 may extend from an upper end of the suction hole 411 to the upper end of the rear plate 410 and have a size coming into contact with both ends of the side duct 430. Thus, the first insulation material 440 may be mounted to prevent a large amount of cold air generated in the second evaporator from thermally conducted through the rear plate 410 to affect the temperature within the refrigerator.

That is, when the first insulation material 440 is not provided, air may be cooled by the second evaporator 500 due to the structural characteristics of the rear plate 410 disposed adjacent to the second evaporator 500 and thus has a below zero temperature. As a result, the surface of the rear plate 410 may be frozen, or the rear portion within the refrigerating compartment 12 may be excessively cooled. However, the first insulation material 440 may be provided to minimize the transfer of the cold air generated in the second evaporator 500 to the rear plate 410, thereby preventing the rear plate 410 from being frozen.

Also, the second evaporator 500 may be disposed at a rear side of the first insulation material 440. The second evaporator 500 may be disposed in the heat-exchange space 460 defined by the side ducts 430 and the first insulation material 440.

The second evaporator 500 may be the roll bond type evaporator in which a refrigerant passage 520 is provided by a pair of plates 510 connected to overlap each other. That is, the second evaporator 500 may have a plate shape which is accommodated in the heat-exchange space 460. The second evaporator may have a thin thickness and a plate shape due to the structural characteristics of the roll bond type evaporator.

The second evaporator may have a width corresponding to the horizontal width of the heat-exchange space 460 and be disposed above the suction hole 411. Thus, the cold air introduced into the suction hole 411 may move upward along the second evaporator 500 and then be cooled.

The refrigerant passage 520 protruding from an outer surface of the second evaporator 500 may have a meandering shape of which both ends are repeatedly bent several times. Also, the refrigerant passage 520 may have a structure that extends in a horizontal direction. Thus, the refrigerant may slowly flow within the heat-exchange space 460 to more cool the air flowing along the inside of the heat-exchange space 460.

Also, a plurality of evaporator holes 511 may be further defined in the second evaporator 500. The evaporator holes 511 may be holes to which a screw 537 for fixing and mounting the second evaporator 500 are coupled. The evaporator holes 511 may be provided in plurality at a position corresponding to an evaporator fixing member 530 that will be described below.

The second insulation material 450 may be made of the same material as the first insulation material 440 and have a plate shape like the first insulation material 440. The second insulation material 450 may have a size corresponding to or greater than that of the second evaporator 500 to cover the second evaporator 500 at the rear side. The second insulation material 450 may be attached to an outer surface of the inner case 102.

The second insulation material 450 may be configured to prevent the cold air of the second evaporator 500 from leaking to the rear surface of the inner case 102 and have a size that is capable of defining the rear surface of the heat-exchange space 460.

Thus, the cold air flowing backward by the second insulation material 450 may be blocked by the second insulation material 450 and prevented from being transferred to the inner case 102. Particularly, when the inner case 102 is made of a metal material, and the second insulation material 450 is not provided, the cold air may unnecessarily leak to the other space except for the cooling space through the inner case 102. However, the second insulation material 450 may be provided to prevent the cold air from leaking.

A plurality of insulation holes 451 may be defined in the second insulation material 450. The insulation holes 451 may be opened so that the evaporator fixing member 530 for fixing and mounting the second evaporator 500 is inserted and be defined in a position corresponding to the evaporator holes 511.

In the state in which the evaporator cover module 400 is mounted inside the refrigerating compartment 12, the second evaporator 500 may be disposed in a space between the first insulation material 440 and the second insulation material 450. Here, the first insulation material 440 and the second insulation material 450 may be maintained at a set interval therebetween so that the air cooled by the second evaporator 500 smoothly flows.

Figure 12:
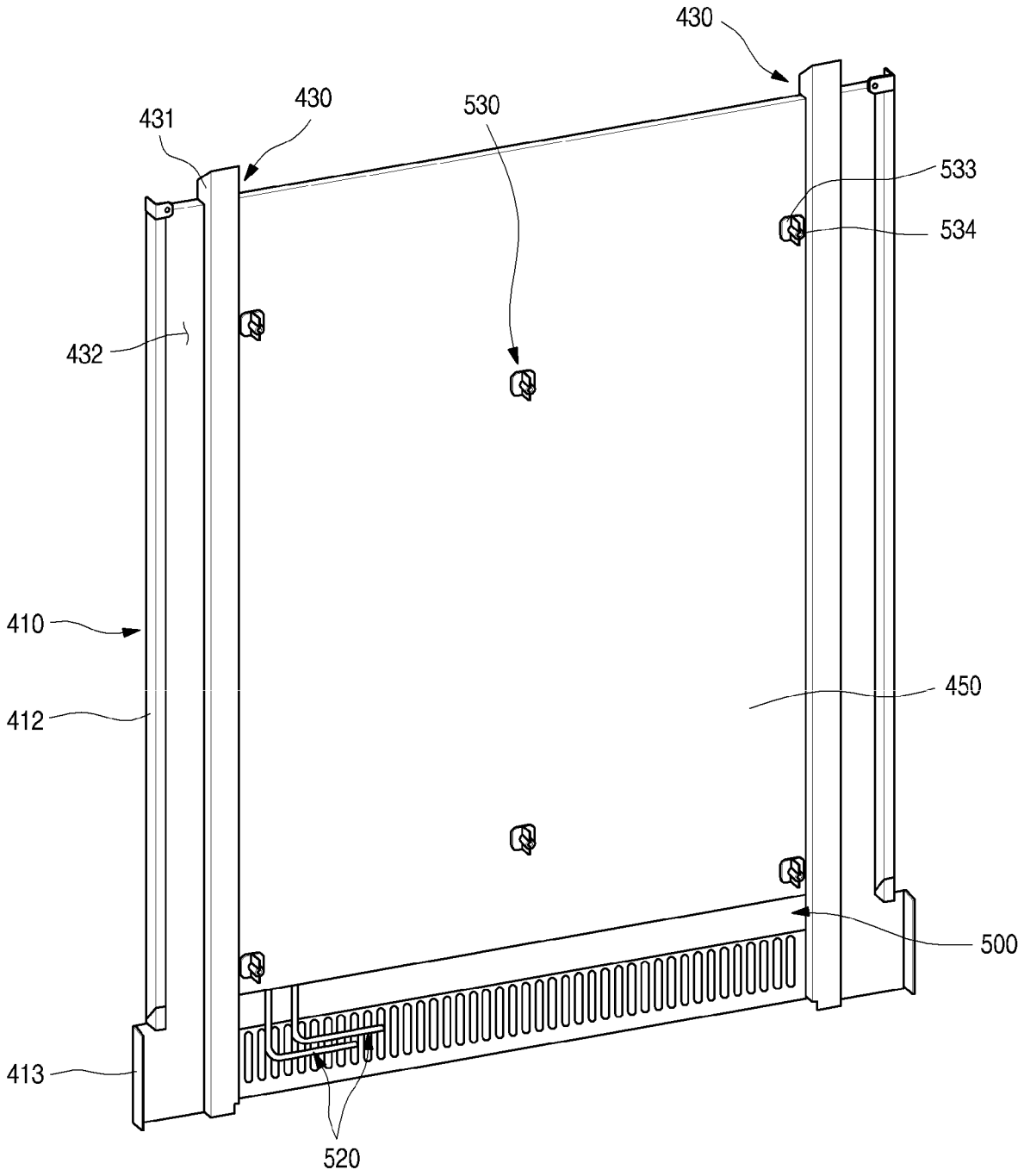
FIG. 12 is a perspective view illustrating a state in which the evaporator cover module and the roll bond evaporator are coupled to each other.
Figure 13:
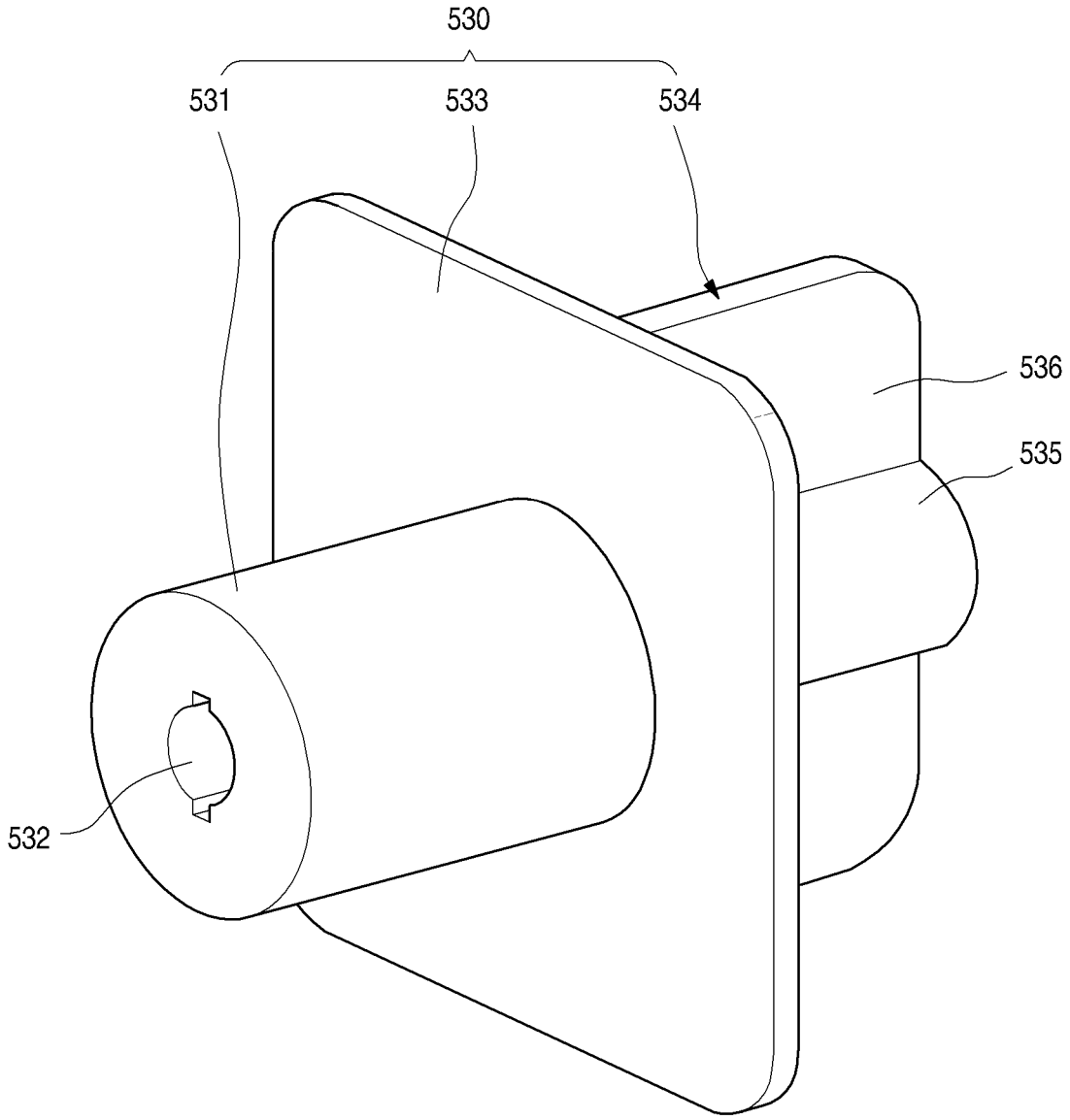
FIG. 13 is a perspective view of an evaporator fixing member according to an embodiment.
Figure 14:
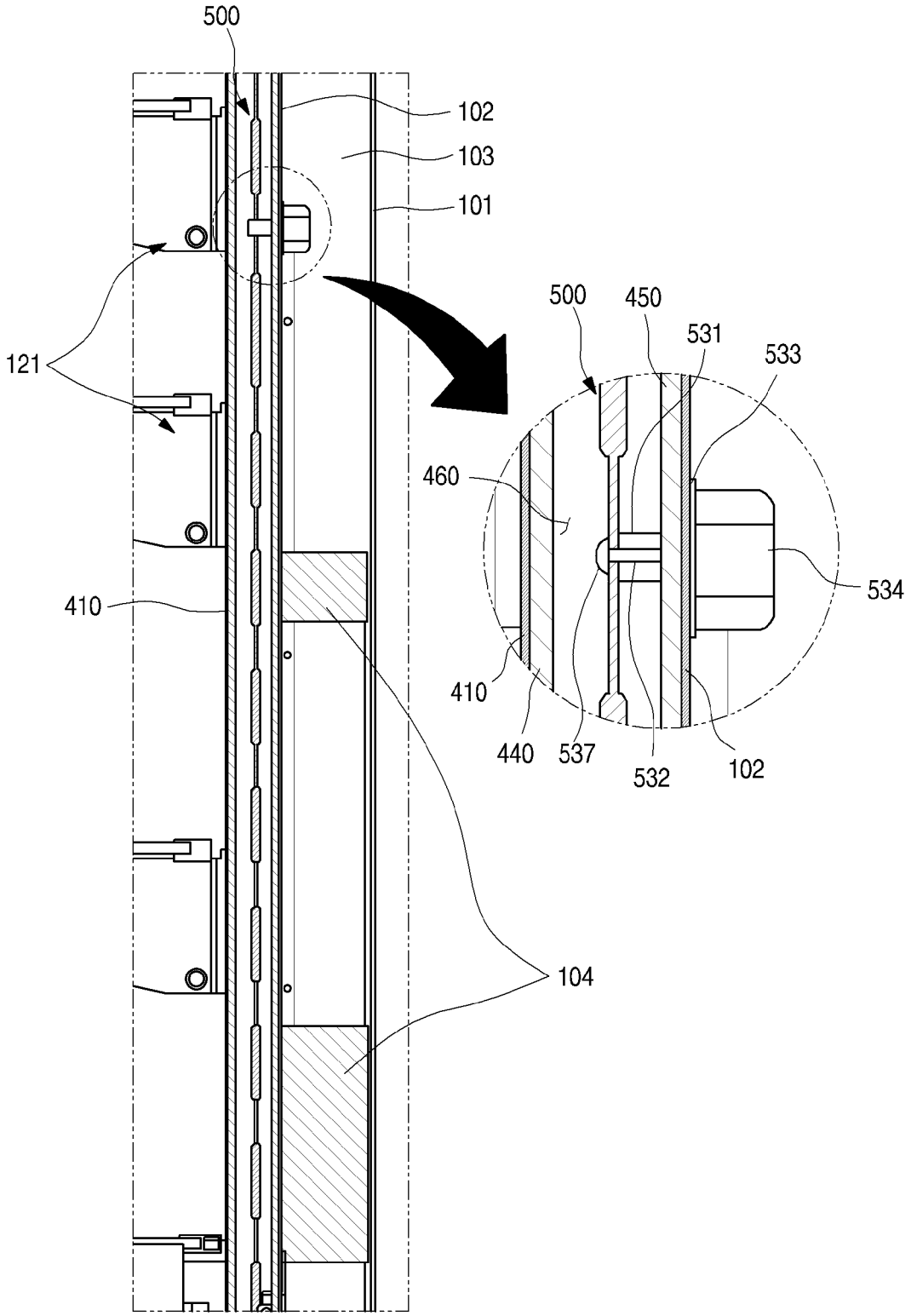
FIG. 14 is an enlarged view of a portion A of FIG. 4.

FIG. 12 is a perspective view illustrating a state in which the evaporator cover module and the roll bond evaporator are coupled to each other. Also, FIG. 13 is a perspective view of the evaporator fixing member according to an embodiment. Also, FIG. 14 is an enlarged view of a portion A of FIG. 4.

As illustrated in the drawings, the evaporator fixing member 530 may be disposed a rear side of the evaporator cover module 400. The evaporator fixing member 530 may be configured so that the second evaporator 500 is fixed and mounted inside the evaporator cover module 400.

The evaporator fixing member 530 may be provided in plurality to wholly fix the second evaporator 500 and maintain a certain distance between the second evaporator 500 and the evaporator cover module 400. The evaporator fixing members 530 may be disposed at upper and lower ends and a center to fix and support the second evaporator 500.

In more detail, as illustrated in FIG. 12, a pair of evaporator fixing members 530 may be disposed on both left and right ends at the upper and lower ends of the second evaporator 500, and a pair of evaporator fixing members 530 may be disposed at the center in a state in which the evaporator fixing members 530 are spaced apart from each other. Thus, the second evaporator 500 may be stably fixed and mounted on an entire surface of the evaporator fixing member 530.

In addition, the second evaporator 500 may be maintained at a predetermined distance inside the heat-exchange space 460 by the evaporator fixing member 530. That is, it may prevent the second evaporator 500 from being changed in position or prevent a distance between an inner wall of the heat-exchange space 460 and the second evaporator 500 from being narrowed by deformation of the evaporator cover module 400 during the assembly process or during the use. Thus, when the second evaporator 500 is defrosted, even though water droplets are generated, the water droplets may not be formed between the second evaporator 500 and the inner wall of the heat-exchange space 460, but flow downward. Also, flow resistance generated when the cold air flows may be prevented from increasing.

It is preferable that a distance between the outer surface of the second evaporator 500 and the heat-exchange space 460 is a distance that is enough to prevent defrost water from being formed by surface tension. The second evaporator 500 may be maintained at a set distance from the inner surface of the heat-exchange space 460 by the evaporator fixing member 530.

The evaporator fixing member 530 may be coupled by passing through the inner case 102 at the rear side of the inner case 102 and may successively pass through the second insulation material 450 and the second evaporator 500. Thus, the second evaporator 500 may be supported on the inner case 102 by the evaporator fixing member 530. Alternatively, the evaporator fixing member 530 may be mounted on the second insulation material 450.

As illustrated in FIG. 13, the evaporator fixing member 530 may include a boss part 531 and a handle 534.

The boss part 531 may define a front portion of the evaporator fixing member 530 and protrude forward from a center of the support plate 533. The boss part 531 may have a length by which the boss part 531 passes through the inner case 102 and the second insulation material 450 to support the second evaporator 500.

Also, a boss hole 335 may be defined in a center of a front surface of the boss part 531, and the screw 537 passing through the evaporator hole 511 may be coupled to a boss part hole 532 to support the second evaporator 500. That is, distances between the second evaporator 500 and the first insulation material 440 and the second insulation material 450 may be adjusted by the extending length of the boss part 531. In this embodiment, the boss part 531 may be disposed so that the second evaporator 500 is disposed at an approximately central portion between the first insulation material 440 and the second insulation material 450.

The support plate 533 may have a plate shape at a rear end of the boss part 531 to extend in a circumferential direction of the boss part 531 and come into surface contact with the inner case 102. The support plate 533 may have various shapes that are capable of coming into surface contact with the inner case 102. In this embodiment, the support plate 533 may have a rectangular plate shape. Thus, when the evaporator fixing member 530 is mounted, the evaporator fixing member 530 may adhere to a rear surface of the inner case 102.

The handle 534 may protrude backward from the center of the support plate 533 and include a handle shaft 535 at the center of the support plate 533 and a handle rib 536 extending upward and downward from an outer surface of the handle shaft 535.

The handle rib 536 may extend from the outer surface of the handle shaft 535 to an outer end of the support plate 533. That is, the handle rib 536 may protrude at a predetermined height so that the user holds the handle rib 536 by using a hand thereof.

The handle 534 may have a structure of the handle rib 536 extending from the protruding handle shaft 535. Thus, the user may hold the handle 534 to insert the handle 534 so that the boss part 531 passes through the inner case 102 and the second insulation material 450, thereby realizing the easy assembly process.

In addition, the handle 534 may be exposed to the space between the inner case 102 and the outer case 101, in which the insulation material 103 is provided. When a foaming solution is injected to mold the insulation material 103, the outer surface of the handle 534 may be buried in the insulation material 103, and thus, the evaporator fixing member 530 may be maintained in the fixed state without being separated.

Hereinafter an operation of the refrigerator having the above-described structure according to the current embodiment will be described.

Figure 15:
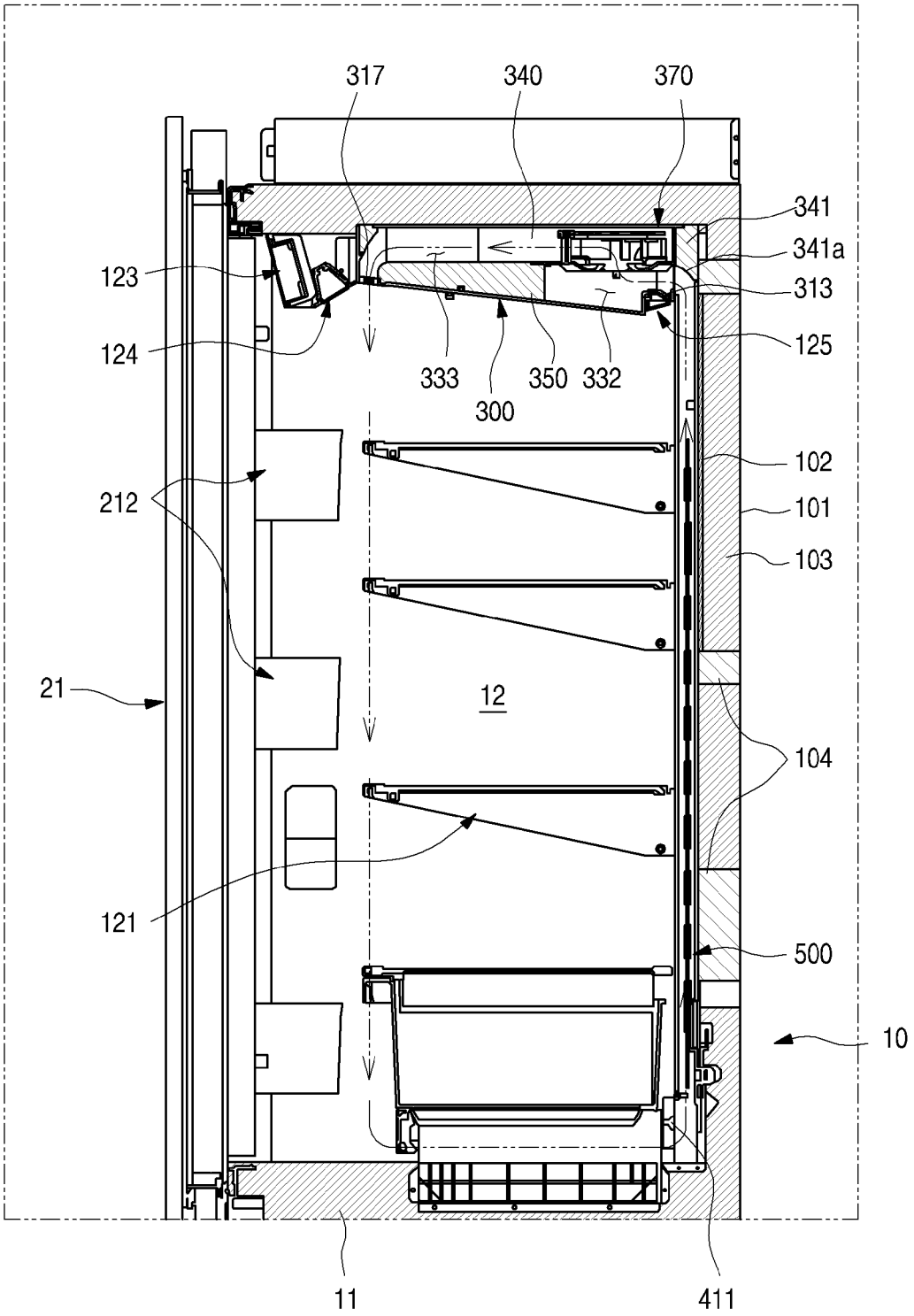
FIG. 15 is a cross-sectional view illustrating a cold air flow state in a refrigerating compartment of the refrigerator.
Figure 16:
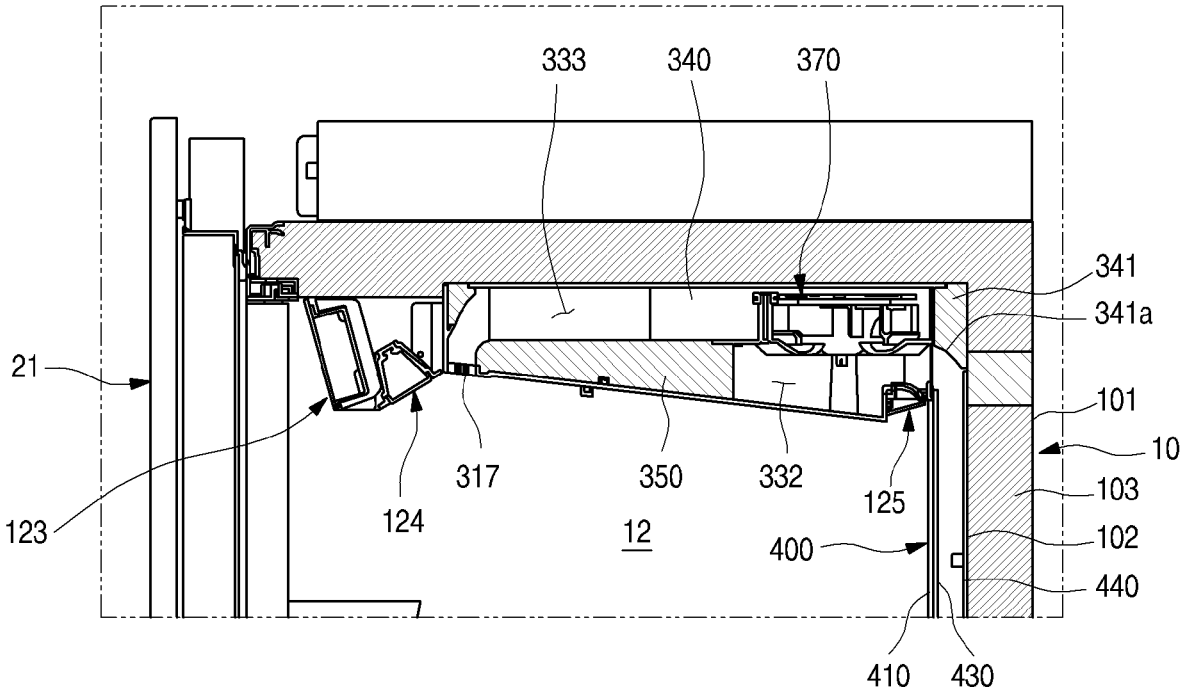
FIG. 16 is a cross-sectional view illustrating a cold air flow state in the evaporator cover module and the cold air supply module.
Figure 17:
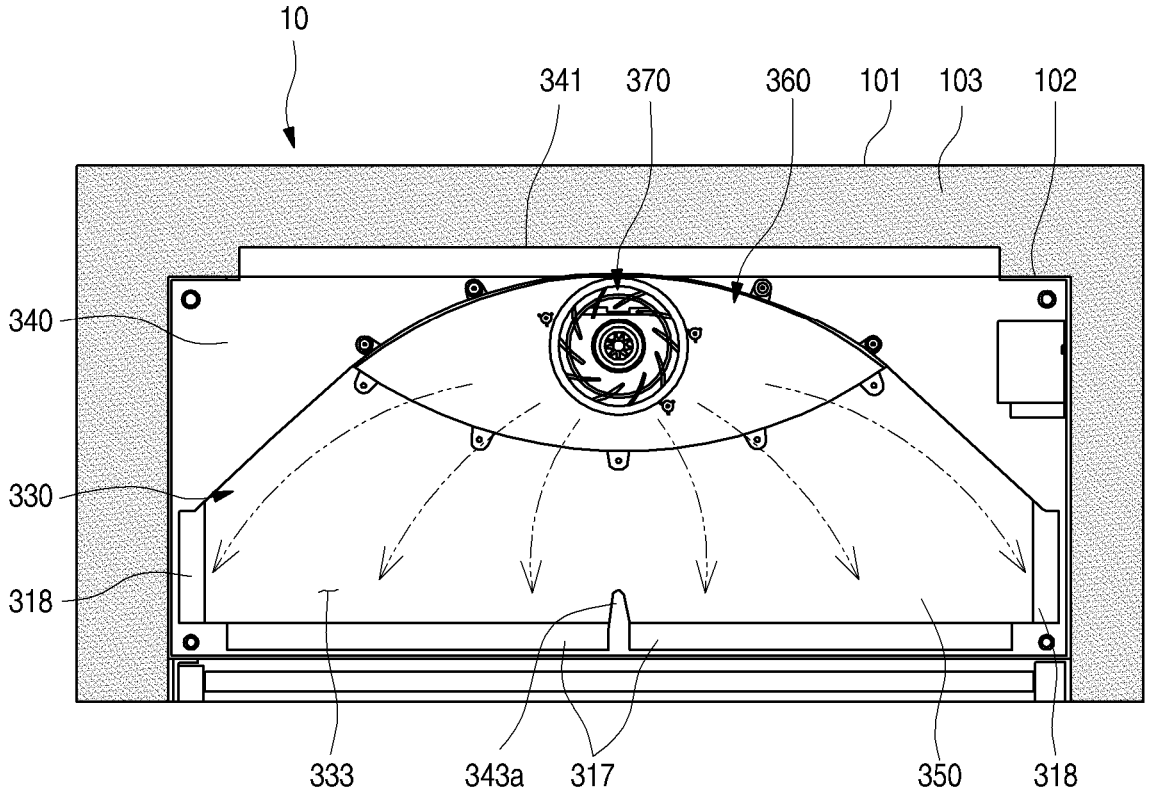
FIG. 17 is a cross-sectional view illustrating a cold air flow state in the cold air supply module.
Figure 18:
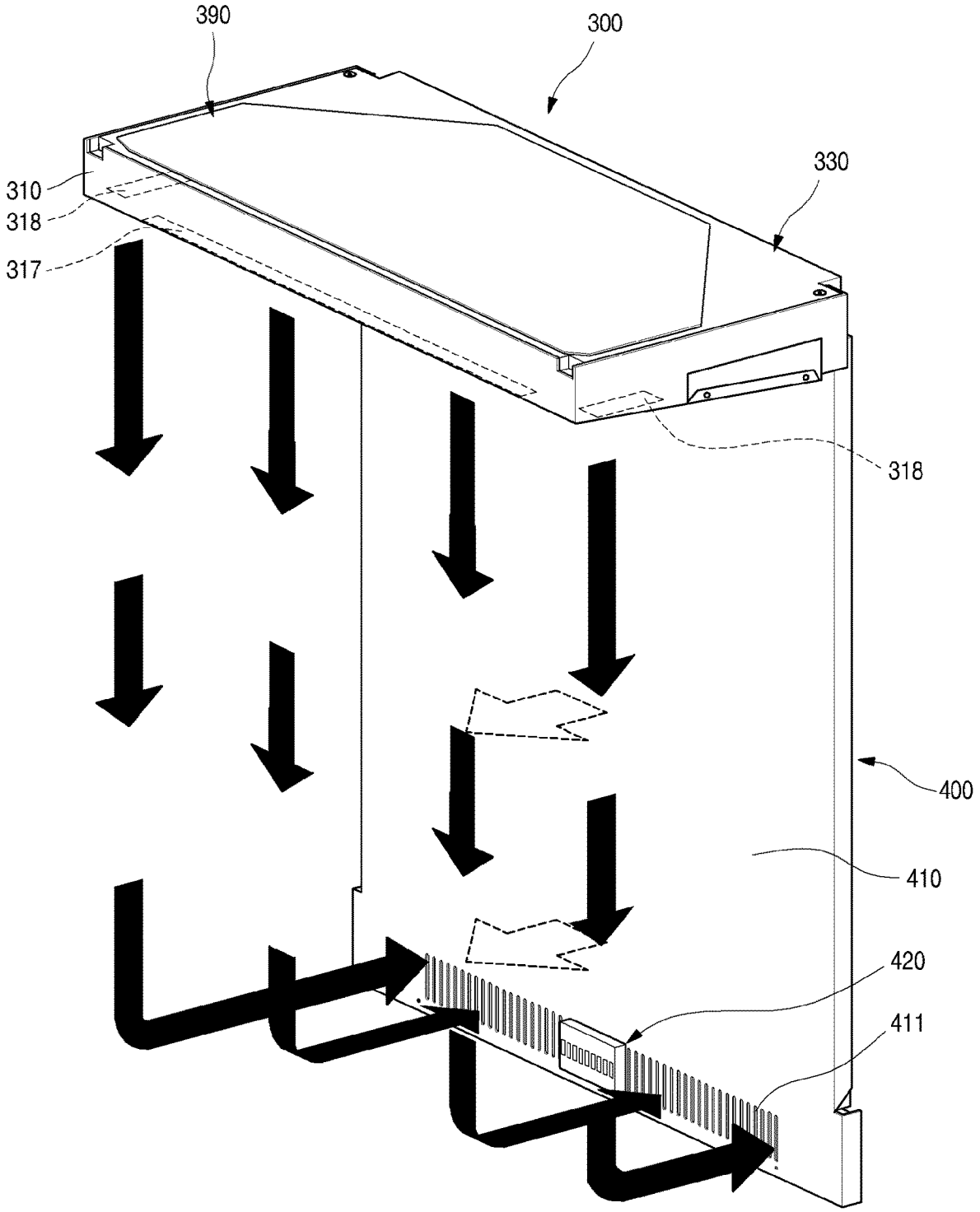
FIG. 18 is a view illustrating a cooling state inside the refrigerating compartment.

FIG. 15 is a cross-sectional view illustrating a cold air flow state in the refrigerating compartment of the refrigerator. Also, FIG. 16 is a cross-sectional view illustrating a cold air flow state in the evaporator cover module and the cold air supply module. Also, FIG. 17 is a cross-sectional view illustrating a cold air flow state in the cold air supply module. Also, FIG. 18 is a view illustrating a cooling state inside the refrigerating compartment.

As illustrated in the drawings, the inside of the storage space of the refrigerator 1 may be cooled to a set temperature by an operation of the refrigeration cycle.

To cool the inside of the refrigerating compartment 12 to a set temperature, the refrigeration cycle including the second compressor 162 and the second evaporator 500 is driven. Also, when the refrigerating compartment blower fan 370 provided in the cold air supply module 300 is driven, a flow of the cooling air within the refrigerating compartment 12 may start to cool the inside of the refrigerator 1.

In detail, when the second compressor 162 is driven, the second evaporator 500 may be in a low-temperature state and also in a state in which cold air is capable of being generated. In this state, when the refrigerating compartment blower fan 370 is driven, the cold air may be suctioned through the evaporator cover module 400 and discharged through the cold air supply module 300. The suction hole 411 of the evaporator cover module 400 may be defined in a lower end area of the refrigerating compartment 12 to suction the cold air existing at the lower portion of the refrigerating compartment 12. Also, the cold air may move upward along the heat-exchange space 460 within the evaporator cover module 400.

Here, the second evaporator 500 is disposed in the heat-exchange space 460, and the cold air is introduced into the cold air supply module 300 after being sufficiently cooled while moving upward along the heat-exchange space 460.

The cold air introduced into the cold air supply module 300 may forcibly flow by the refrigerating compartment blower fan 370 and be discharged downward through the discharge holes 317 and 318 of the cold air supply module 300. Here, the cold air supply module 300 may be disposed on the top surface of the refrigerating compartment 12 to supply the cold air to the lower side of the refrigerating compartment 12.

Also, the front discharge port 317 of the cold air supply module 300 may be disposed on the same extension line between the shelf 121 and the drawer within the refrigerating compartment 12 and the door basket 212 within the refrigerating compartment door 21. Thus, the cold air discharged by the cold air supply module 300 may flow to face the bottom of the refrigerating compartment 12 without being blocked by the accommodation members disposed on the refrigerating compartment 12 and the refrigerating compartment door or the foods accommodated in the accommodation members.

Thus, the cold air within the refrigerating compartment 12 may move upward through the rear surface of the refrigerating compartment 12 from the bottom of the refrigerating compartment 12 and then move forward from the upper end of the refrigerating compartment 12 so as to move again toward the bottom of the refrigerating compartment 12 to circulate. The whole cooling within the refrigerating compartment 12 may be enabled through the above-described process.

A cold air flow state in an upper region of the refrigerating compartment 12 will be described in more detail with reference to FIG. 16. Since the upper end of the evaporator cover module 400 is coupled to the lower end of the cold air supply module 300, the cold air flowing upward within the heat-exchange space 460 may be introduced into the cold air supply module 300 through the inlet part 341.

The cold air passing through the upper end of the evaporator cover module 400 may be introduced into the lower passage 332 within the cold air supply module 300 through the inlet part 341. Here, the guide surface 341*a* may be disposed on the inner surface of the inlet part 341 communicating with the lower passage 332. The guide surface 341*a* may have a rounded curved shape and be connected to the lower passage 332 disposed parallel to the upper end, which extends and is opened in the vertical direction. Thus, the cold air flowing upward through the evaporator cover module 400 may be smoothly introduced into the cold air supply module 300.

Also, a lighting device mounting part 313 on which the lighting device 125 is mounted may be disposed on the lower case 110 in a direction facing the guide surface 341*a*. The lighting device mounting part 313 may be recessed to have a curved surface at a position corresponding to the guide surface 341*a* to more smoothly guide the introduction of the cold air together with the guide surface 341*a*.

The lower passage 332 may be a space between the upper part 340 of the passage formation part 330 and the lower case 310 and define a lower space of the refrigerating compartment blower fan 370. Thus, the cold air introduced through the inlet part 341 may flow to the inside of the refrigerating compartment blower fan 370 from the lower side of the refrigerating compartment blower fan 370.

The refrigerating compartment blower fan 370 may be a centrifugal fan that suctions air in a central direction to discharge the air in a circumferential direction. A fan having a high air volume such as a turbo fan may be used as the refrigerating compartment blower fan 370. Here, the rotation shaft of the refrigerating compartment blower fan 370 may be vertically disposed, and the bottom surface of the refrigerating compartment blower fan 370 may be disposed in parallel to the top surface of the refrigerating compartment to minimize the installation space.

The air suctioned in the shaft direction may be discharged in the circumferential direction by the rotation of the refrigerating compartment blower fan 370 and then move forward along the upper passage 333 and discharged downward through the discharge ports 317 and 318.

The cold air flow within the cold air supply module 300 will be described in more detail with reference to FIG. 17. The cold air suctioned in the shaft direction of the refrigerating compartment fan 370 by the rotation of the refrigerating compartment blower fan 370 may be discharged in the circumferential direction.

Here, a portion of the cold air blown by the refrigerating compartment blower fan 370 may flow along the discharge guide surface 342 to flow to the side discharge port 318 along the discharge guide surface 342. Also, the remaining cold air blown by the refrigerating compartment blower fan 370 may flow forward along the upper passage 333 to flow to the front discharge port 317. That is, the cold air discharged in the circumferential direction of the refrigerating compartment blower fan 370 may flow along the upper passage 333 and then be discharged through the front discharge port 317 and the side discharge ports 318.

As illustrated in FIG. 18, in the flow of the cold air for cooling the inside of the refrigerating compartment 12, the cold air suctioned through the suction hole 411 from the lower end of the refrigerating compartment 12 may flow upward along the heat-exchange space 460 within the evaporator cover module 400. Also, the cold air introduced into the cold air supply module 300 from the upper end of the heat-exchange space 460 may flow to the side discharge ports 318 and the front discharge port 317 through the upper passage 333 by the operation of the refrigerating compartment blower fan 370.

The front discharge port 317 and the side discharge ports 318 may be disposed at the front end of the top surface and both side surfaces of the front portion of the refrigerating compartment 12 to discharge the cold air to the inside of the refrigerating compartment 12. Also, the cold air discharged downward may flow again to the suction hole 411 from the lower end of the refrigerating compartment 12.

As described above, the cold air discharged from the front discharge port 317 and the side discharge ports 318 may flow downward along the front end and both side ends of the refrigerating compartment 12 to define a wall of the cold air and thereby to three-dimensionally cool the whole inside of the refrigerating compartment 12.

Particularly, most of the cold air generated in the second evaporator 500, which is covered by the evaporator cover module 400, may be blocked by the first insulation material 440, but a portion of the cold air may be transferred to the outside via the first insulation material 440. Thus, the rear wall of the refrigerating compartment 12 may not be in an extremely low-temperature state such as the temperature of the second evaporator 500. However, the cold air having an adequate temperature that is necessary for cooling the refrigerating compartment 12 may directly cool the rear wall of the refrigerating compartment 12 via the first insulation material 440.

Therefore, as illustrated in FIG. 18, the rear surface as well as the top surface, the bottom surface, the front surface, and the left and right surfaces of the refrigerating compartment 12 may be cooled to three-dimensionally cool the entire inner surfaces of the refrigerating compartment 12.

The following effects may be expected in the refrigerator according to the proposed embodiments.

The refrigerator may have the structure that is provided with the cold air supply module in which the roll bond type evaporator for cooling the inside of the refrigerator and the evaporator cover module for providing the cold air passage through the roll bond type evaporator are disposed on the rear surface, and the blower fan coupled to the evaporator cover module to forcibly blow the cold air is disposed on the top surface within the refrigerator.

Thus, the space in which the evaporator for supplying the cold air into the refrigerator may be reduced to expand the storage space by the reduced accommodation space for the evaporator.

Also, the cold air supply module for discharging the cold air into the refrigerator may be disposed on the top surface within the refrigerator to secure the storage space in the front and rear direction. In addition, since the cold air supply module has the structure in which the bottom surface is gradually lowered backward from the front side, the accommodation of the blower fan and the secure of the passage may be enabled, and it may be effective to make the inner space of the refrigerator visually wider.

Also, the blower fan having the turbo fan structure may be disposed inside the cold air supply module, and the blower fan may have the structure in which the top surface of the inner space of the refrigerator vertically crosses the rotation shaft, and the bottom surface is parallelly disposed to occupy the minimum space and realize the structure in which the cold air smoothly flows.

Also, the plurality of refrigeration cycles may be independently provided in the refrigerator having the plurality of storage spaces. The roll bond type evaporator may be disposed to cool the refrigerating compartment having the relatively high temperature and the large storage space, and the fin-type heat exchanger may be disposed to cool the freezing compartment having the relatively low temperature and the small storage space, thereby independently performing the cooling.

Thus, each of the spaces may be cooled in the completely independent state and also effectively cooled to a desired temperature. In addition, the refrigerating compartment space having the relatively low temperature may be independently cooled, and also, the storage space may be expanded.

Also, the entire inner case defining the inside of the refrigerator may be made of the metal material so that the refrigerator is manufactured with the simpler structure, and also, the outer appearance of the refrigerator may be more elegant.

However, in the above-described structure, when the roll bond type evaporator is disposed on the rear wall surface within the refrigerator, the cold air may not be transferred to the storage space but be transferred to the rear wall surface of the inner case to deteriorate the cooling performance. Thus, the cold air transferred backward may be blocked by the plate-shaped insulation material disposed on the evaporator cover module to prevent the heat loss from occurring and also prevent the cooling efficiency from being deteriorated.

Also, the cold air supply module may discharge the cold air downward from the top surface within the refrigerator and particularly discharge the cold air downward from the front end and both the side ends to provide the wall of the cold air on the wall within the refrigerator. Thus, the penetration of the heat load through the wall surface of the refrigerator may be effectively prevented. Also, in the built-in type refrigerator that is buried in the wall or the furniture, the heat exchange between the inside and the outside of the refrigerator may be more effectively prevented.

Particularly, since the roll bond type evaporator in addition to the cold air supply module is disposed on the rear wall, the wall of the cold air may be defined on the entire surface of the refrigerating compartment. Thus, the penetration of the heat load may be prevented, and also, the inside of the refrigerator may be three-dimensionally cooled.

The evaporator may be stably fixed by the evaporator fixing member within the heat-exchange space having the narrow width, and the distance between the evaporator and the inner surface of the heat-exchange space may be maintained to easily discharge the defrost water even in the heat-exchange space having the minimum thickness and also allow the cold air to flow.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet comprising an outer case that defines an outer appearance of the cabinet and an inner case that defines a storage space;

an evaporator located at a surface of the inner case;

an evaporator cover module that defines an inner wall of the storage space, the evaporator cover module defining a heat-exchange space that is configured to accommodate the evaporator and that allows flow of cold air inside of the evaporator cover module;

a cold air supply module located at a top surface of the storage space and configured to communicate with an upper end of the evaporator cover module, the cold air supply module comprising a discharge port configured to discharge cold air toward the storage space; and a blower fan located at the cold air supply module and configured to cause circulation of cold air in the storage space, wherein the cold air supply module comprises:

a lower passage defined at a lower side of the cold air supply module and configured to communicate with the evaporator cover module, an upper passage defined at an upper side of the cold air supply module and configured to communicate with the discharge port, a passage formation part that defines the upper passage and the lower passage, a lower case that accommodates the passage formation part and that is configured to cover the lower passage, and an upper case that is located at a top surface of the passage formation part and that is configured to cover the upper passage, wherein the cold air supply module defines a communication hole at a position where the upper passage and the lower passage overlap each other, wherein the blower fan is located at the communication hole to cause suction of cold air from the heat-exchange space and discharge of cold air to the discharge port, and wherein the blower fan is configured to cause suction of cold air through the upper passage and discharge of cold air through the lower passage.

2. The refrigerator according to claim 1, wherein the blower fan includes a rotation shaft located between the upper passage and the lower passage, and wherein the blower fan is configured to suction cold air in an axial direction of the rotation shaft and to discharge cold air in a circumferential direction of the rotation shaft.

3. The refrigerator according to claim 2, wherein the rotation shaft is oriented in the axial direction that crosses the top surface of the storage space or a bottom surface of the storage space.

4. The refrigerator according to claim 1, wherein the passage formation part comprises:

a lower part that defines the lower passage at a position between the blower fan and the evaporator cover module; and an upper part that is located vertically above the lower part and that defines the upper passage at a position between the blower fan and the discharge port.

5. The refrigerator according to claim 4, wherein the upper part of the passage formation part comprises:

an inlet part that protrudes backward of the lower part, that is coupled to the upper end of the evaporator cover module, and that is configured to receive cold air from the evaporator cover module; and a guide surface that is located inside of the inlet part and that is configured to guide cold air received from the evaporator cover module to the discharge port.

6. The refrigerator according to claim 5, wherein the lower part of the passage formation part comprises: a lighting device mounting part having an outer surface that faces toward the inlet part, that is configured to guide flow of cold air, and that has a round shape corresponding to the guide surface.

7. The refrigerator according to claim 4, wherein the cold air supply module defines:

a front discharge port at a front end of the cold air supply module; and a side discharge port at each of left and right ends of the cold air supply module, and wherein the passage formation part defines:

a front opening located at a front end of the passage formation part and configured to communicate with the front discharge port, and a side opening located at each of left and right ends of the passage formation part and configured to communicate with the side discharge port.

8. The refrigerator according to claim 7, wherein the upper part defines a discharge guide surface that has a rounded or inclined shape extending toward a rear end of each side opening, that passes through a rear side of the blower fan, and that is configured to guide cold air discharged from the blower fan to the front opening and to each side opening.

9. The refrigerator according to claim 8, wherein the cold air supply module further comprises a fan bracket configured to cover the communication hole and located at the passage formation part, the fan bracket comprising:

a shroud that is configured to cover the communication hole, the shroud defining an orifice that allows introduction of air into the blower fan; and a bracket edge disposed along a circumference of the shroud, the bracket edge comprising a bent portion that contacts the discharge guide surface.

10. The refrigerator according to claim 9, further comprising a fan support that extends upward from a circumference of the orifice and that is configured to support the blower fan at a position corresponding to the orifice.

11. The refrigerator according to claim 7, wherein the passage formation part further comprises a distribution part that partitions the front opening and that is configured to distribute cold air passing through the front opening.

12. The refrigerator according to claim 4, wherein a forward portion of the upper part is vertically wider than a backward portion of the upper part, and wherein a backward portion of the lower part is vertically wider than a forward portion of the lower part.

13. The refrigerator according to claim 1, wherein the passage formation part further comprises a case mounting part that is located at a top surface of the passage formation part and that is stepped along a circumference of a top surface of the upper passage, and wherein the upper case of the cold air supply module has a shape corresponding to the case mounting part, and is configured to cover the top surface of the upper passage and a top surface of the blower fan.

14. The refrigerator according to claim 1, wherein the inner case of the cabinet comprises one or more metal plates coupled to each other.

15. The refrigerator according to claim 14, wherein the cold air supply module further comprises a base plate that is configured to couple to a bottom surface of the lower case, that has a planar shape, and that is made of a same material as the inner case, the base plate defining an outer appearance of a bottom surface of the cold air supply module.

16. The refrigerator according to claim 1, wherein the evaporator cover module comprises:

a rear plate that defines a rear wall of the storage space and that defines a suction hole configured to receive cold air from the storage space;

a first insulation that is coupled to a rear surface of the rear plate and that covers a front side of the evaporator; and a second insulation that is spaced apart from the first insulation, that is coupled to the inner case of the cabinet, and that covers a rear side of the evaporator, wherein the heat-exchange space is defined between the first insulation and the second insulation.

17. The refrigerator according to claim 16, wherein the evaporator cover module further comprises a pair of side ducts that are located at a rear surface of the evaporator cover module, and wherein the pair of side ducts define side surfaces of the heat-exchange space, and allow flow of cold air through the evaporator, each side duct contacting a side end of the evaporator.

18. The refrigerator according to claim 1, wherein the cabinet comprises a refrigerating compartment and a freezing compartment, wherein the evaporator is a roll bond evaporator located at the refrigerating compartment, and wherein the refrigerator further comprises a fin evaporator located at the freezing compartment.

19. The refrigerator according to claim 18, further comprising:

a first compressor that is connected to the roll bond evaporator and that defines a first refrigeration cycle; and a second compressor that is connected to the fin evaporator and that defines a second refrigeration cycle independent of the first refrigeration cycle.

* * * * *